US007269380B2

(12) United States Patent
Yamada

(10) Patent No.: US 7,269,380 B2
(45) Date of Patent: Sep. 11, 2007

(54) IMAGE FORMING APPARATUS

(75) Inventor: Masatomo Yamada, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 73 days.

(21) Appl. No.: 10/784,832

(22) Filed: Feb. 24, 2004

(65) Prior Publication Data

US 2005/0002695 A1 Jan. 6, 2005

(30) Foreign Application Priority Data

Jul. 3, 2003 (JP) ..... 2003-191254

(51) Int. Cl.
*G03G 15/01* (2006.01)

(52) U.S. Cl. ..... 399/227; 399/302

(58) Field of Classification Search ..... 399/227, 399/302

See application file for complete search history.

(56) References Cited

U.S. PATENT DOCUMENTS

| | | | | |
|---|---|---|---|---|
| 6,718,148 | B2 * | 4/2004 | Kobayashi et al. | 399/113 |
| 6,766,124 | B2 * | 7/2004 | Taguchi et al. | 399/66 |
| 6,853,825 | B2 * | 2/2005 | Suzuki et al. | 399/167 |
| 6,895,204 | B2 * | 5/2005 | Shin | 399/296 |

FOREIGN PATENT DOCUMENTS

| | | |
|---|---|---|
| JP | 10-339983 | 12/1998 |
| JP | 2000-298382 | 10/2000 |
| JP | 2001-83800 | 3/2001 |
| JP | 2001-175077 | 6/2001 |
| JP | 2002-341706 | 11/2002 |
| JP | 2003-156907 | 5/2003 |

* cited by examiner

*Primary Examiner*—David M. Gray
*Assistant Examiner*—Ryan D. Walsh
(74) *Attorney, Agent, or Firm*—Morgan, Lewis & Bockius LLP

(57) ABSTRACT

An image forming apparatus includes an image carrier which has a predetermined center of rotation and on which a toner image is formed, a developing device which has a developing roll that rotates while carrying a toner on the surface thereof and that conveys the toner to a developing position, an intermediate transfer member which is disposed in an approximately flat shape and circulatingly moves, and a fixing unit which fixes the toner image on the transfer material thereon at a predetermined fixing position. In the image forming apparatus arranged as described above, both the image carrier and the developing roll are disposed in a triangle region formed by the approximately flat-shaped intermediate transfer member, a vertical line in contact with the intermediate transfer member, and a horizontal line in contact with the intermediate transfer member, thereby the size of the image forming apparatus can be more reduced.

8 Claims, 22 Drawing Sheets

IMAGE FORMING APPARATUS

BACKGROUND OF THE INVENTION

1. Field of the Invention

The present invention relates to an image forming apparatus that forms an electrostatic latent image on an image carrier, forms a toner image by developing the electrostatic latent image with respective color toners, and forms a color image on a transfer material by transferring and fixing the toner image to and on the transfer material through an intermediate transfer member.

2. Description of the Related Art

Heretofore, the above type of image forming apparatuses have become widespread as image forming apparatuses for forming, for example, a high quality color image.

As one of the image forming apparatuses, there is known a so-called tandem type image forming apparatus in which four sets of image carriers are disposed in correspondence to four colors of cyan (C), magenta (M), yellow (Y), and black (K), each of the image carriers shares formation of a toner image of one of the colors, and the toner images of the four colors are superimposed on an intermediate transfer unit and transferred onto a sheet at a time (refer to, for example, Japanese Patent Application Laid-open No. 2003-156907). In the tandem type image forming apparatus, since the respective image carriers share the formation of the toner images of the respective colors, the toner images of the respective colors can be simultaneously formed, and thus the image forming apparatus is suitable to form an image at a high speed. In the tandem system, however, a problem arises in that the size of the image forming apparatus is increased because various components as many as the four image carriers must be disposed around the image carriers and further a large intermediate transfer unit, which moves across all of the four image carriers, is required. Further, a problem also arises in that since any unit except a fixing unit is disposed on the side of the large-sized intermediate transfer unit opposite to the side thereof where the image carriers are disposed, a large dead space occurs on the side where only the fixing unit is disposed.

In contrast, there is also known an image forming apparatus of a type that employs only one set of an image carrier to reduce the size and the cost of the apparatus and causes the one image carrier to sequentially form toner images having the respective colors of C, M, Y, K (refer to, for example, Japanese Patent Application Laid-open No. 10-339983). This type of the image forming apparatus forms an image at a low speed because the toner images of the respective color toners must be sequentially formed by the one image carrier. However, since an image is formed using only a black toner more frequently on the average, this type of the image forming apparatus has been also accepted from a view point of the reduction in size and cost of the apparatus.

FIG. 21 is a view showing an arrangement of an example of the image forming apparatus shown in Japanese Patent Application Laid-open No. 10-339983.

A photosensitive drum 101 is charged by a charging unit 102 while rotating in the direction of an arrow A about the center of rotation 101*a* thereof, and an electrostatic latent image is formed on the photosensitive drum 101 by the exposure light 103*a* from an exposure unit (not shown) and developed by a rotary developing device 104.

The rotary developing device 104 has plural developing units 104C, 104M, 104Y, and 104K disposed around the center of rotation thereof to execute development using respective color toners, and the electrostatic latent image formed on the photosensitive drum 101 is developed by a developing unit (the developing unit 104Y in the state shown in FIG. 21) which is faced to the photosensitive drum 101 by the rotation of the rotary developing device 104.

A toner image is formed on the photosensitive drum 101 by being developed by the rotary developing device 104 and transferred onto an intermediate transfer belt 106, which circulatingly moves in the direction of an arrow B, by the action of a transfer unit 105 at a primary transfer position 118. After the toner image has been transferred onto the intermediate transfer belt 106, the surface of the photosensitive drum 101 is cleaned by a cleaner 119, a toner image forming operation is executed again by starting the operation from the charge of the photosensitive drum 101 executed by the charging unit 102.

When a color image is formed, the above image forming cycle is repeated four times, thereby a toner image composed of four colors of cyan (C), magenta (M), yellow (Y), and black (K) is formed on the intermediate transfer belt 106.

In contrast, a sheet P is fed from a sheet accommodation unit 107 by a pick-up roll 108, conveyed by conveying rolls 109 along a conveying path 110, sent to a secondary transfer position 112 by registration rolls 111 in exact timing with the toner image formed on the intermediate transfer belt 106 and composed of the four CMYK colors. At the secondary transfer position 112, the four-color toner image on the intermediate transfer belt 106 is secondarily transferred onto the sheet by the action of the transfer unit 113.

The sheet, which has undergone the transfer of the four-color toner image, is conveyed by a conveying belt 114 while carrying the four-color toner image, clamped between a pair of fixing rolls 115*a* disposed on a fixing unit 115 and heated and pressurized thereby, and the toner image is fixed on the sheet.

The sheet, on which the toner image has been fixed, is further conveyed by conveying rolls 116 and discharged externally of a cabinet of the image forming apparatus by sheet discharge rolls 117.

In this type of the image forming apparatus, it is also one of large themes to more reduce the size of the apparatus. Thus, the arrangement of the image forming apparatus shown in FIG. 21 will be examined from a view point of reduction in size.

In the arrangement shown in FIG. 21, the secondary transfer position 112 between the intermediate transfer belt 106 and the transfer unit 113 is disposed upstream of a vertical line passing through the center of rotation 101*a* of the photosensitive drum 101 in a sheet conveying direction. This is one of effective points from the view point of the reduction in size. In the arrangement of FIG. 21, however, the primary transfer position 118 is disposed downstream of the secondary transfer position 112 of the intermediate transfer belt 106 (a portion where the intermediate transfer belt moves in a direction where it separates from the secondary transfer position 112). In this case, the length of the sheet conveying path is increased in a lateral direction, which is very disadvantageous in the reduction of size.

Japanese Patent Application Laid-open No. 2000-298382 proposes an image forming apparatus in which a primary transfer position is disposed upstream of a second transfer position of an intermediate transfer belt (a portion where the intermediate transfer belt moves toward the secondary transfer position).

FIG. 22 is a view showing an arrangement of the image forming apparatus disclosed in Japanese Patent Application Laid-open No. 2000-298382.

In this image forming apparatus, the components that execute the same operations as those of the components shown in FIG. 21 are denoted by the same reference numerals even if they are formed in different shapes and disposed differently for easy understanding. This is also applied likewise to the components explained later with reference to respective figures.

A photosensitive drum 101 is charged by a charging unit 102 while rotating in the direction of an arrow A about the center of rotation 101*a* thereof, and an electrostatic latent image is formed on the photosensitive drum 101 by the exposure light 103*a* from an exposure unit 103 and developed by a rotary developing device 104.

A toner image is formed on the photosensitive drum 101 by being developed by the rotary developing device 104 and transferred onto an intermediate transfer belt 106, which circulatingly moves in the direction of an arrow B, by the action of a transfer unit 105 at a primary transfer position 118. After the toner image has been transferred onto the intermediate transfer belt 106, the surface of the photosensitive drum 101 is cleaned by a cleaner 119, and a toner image forming operation is executed again by starting the operation from the charge of the photosensitive drum 101 executed by the charging unit 102. Waste toners, which have been removed from the photosensitive drum 101 by the cleaning executed by the cleaner 119, are accommodated in a waste toner tank 120.

When a color image is formed, the above image forming cycle is repeated four times, thereby a toner image composed of four colors of cyan (C), magenta (M), yellow (Y), and black (K) is formed on the intermediate transfer belt 106.

In contrast, a sheet P is fed from a sheet accommodation unit 107 by a pick-up roll 108, conveyed by conveying rolls 109 along a conveying path 110, sent to a secondary transfer position 112 by registration rolls 111 in exact timing with the toner image formed on the intermediate transfer belt 106 and composed of the four CMYK colors. At the secondary transfer position 112, the four-color toner image on the intermediate transfer belt 106 is secondarily transferred onto the sheet by the action of the transfer unit 113.

The sheet, which has undergone the transfer of the four-color toner image, is clamped between a pair of fixing rolls 115*a* disposed on a fixing unit 115 while carrying the four-color toner image and heated and pressurized thereby, and the toner image is fixed on the sheet.

The sheet, on which the color image has been formed by fixing the toner image thereon, is further conveyed and discharged onto a sheet discharge tray 121 disposed externally of a cabinet of the image forming apparatus by sheet discharge rolls 117.

In the image forming apparatus shown in FIG. 22, the primary transfer position 118 is disposed upstream of the secondary transfer position 112 of the intermediate transfer belt 106 (a portion where the intermediate transfer belt moves toward the secondary transfer position), which will greatly contribute to reducing the size of the image forming apparatus. Further, the secondary transfer position 112 is disposed upstream in a sheet conveying direction of a horizontal line E that passes through the center of rotation 101*a* of the photosensitive drum 101, which also acts advantageously to the reduction in size of the image forming apparatus.

However, the pair of fixing rolls 115*a*, which constitute the fixing unit 115, for example, are disposed at positions that protrude downstream (upper side) in the sheet conveying direction of any of a horizontal line F, which is in contact with a portion of the intermediate transfer belt 106 on the most downstream side thereof in the sheet conveying direction, and a straight line, which connects the center of rotation 101*a* of the photosensitive drum 101 to the center of rotation 104*a* of the rotary developing device 104. Further, the charging unit 102 is disposed at a position that protrudes upstream (lower side) in the sheet conveying direction of a horizontal line H, which is in contact with a portion of the intermediate transfer belt 106 on the most upstream side thereof. Accordingly, the image forming apparatus has many improving points to reduce the size thereof.

Although the image forming apparatus is shown inaccurately in FIG. 22 because it is illustrated schematically, it is not preferable to curve the toner image on the intermediate transfer belt 106 at a small radius of curvature at the secondary transfer position 112 because disturbance of the image, and the like may be caused thereby. Further, it is also not preferable for the sheet sent from the secondary transfer position 112 to approach the intermediate transfer belt 106 (the toner image on the intermediate transfer belt 106) at a large angle and come into contact it, because disturbance of the image and the like may be also caused thereby. To cope with the above problem, in the arrangement shown in FIG. 22, a support roll 122, which supports the intermediate transfer belt 106 from the inside thereof, must be composed of a large diameter roll, and further a sheet conveying path must be set to permit a sheet to be supplied to the secondary transfer position 112 from the direction of an arrow C in order to reduce a contact angle between the intermediate transfer belt and the sheet.

In this case, when the sheet is curved strongly along a small radius, it may undergo a jam and the like. Thus, the length of the sheet conveying path is increased to supply the sheet to the secondary transfer position 112 from the direction of the arrow C in a state that it curves gradually in a large amount.

Therefore, actually, the length of the sheet conveying path is more increased upwardly of the secondary transfer position as well as the support roll 122 has a larger diameter as compared with the arrangement schematically shown in FIG. 22. As a result, the size of the apparatus is larger than that schematically shown in FIG. 22, which is contrary to the requirement for the reduction in size of the apparatus.

SUMMARY OF THE INVENTION

The present invention has been made in view of the above circumstances and provides an image forming apparatus having a reduced size.

According to an aspect of the present invention, the image forming apparatus (first image forming apparatus) includes:

an image carrier which has a predetermined center of rotation and on which a toner image is formed by developing an electrostatic latent image formed thereon with a toner;

a developing device which has a developing roll that rotates while carrying a toner on the surface thereof and that conveys the toner to a developing position at which the electrostatic latent image on the image carrier is developed by the toner;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material; and a fixing unit which fixes the toner image on the transfer material, which has undergone the transfer of the toner image, thereon at a predetermined fixing position, wherein both the image carrier and the developing roll are disposed in a triangle region formed by the approximately flat-shaped intermediate transfer member, a vertical line in contact with the intermediate transfer member, and a horizontal line in contact with the intermediate transfer member.

In the first image forming apparatus of the present invention, both the image carrier and the developing roll are disposed in the above-described triangle region. Thus, when the partial conveying path extends approximately vertically, a height can be mainly reduced, and when it extends approximately horizontally, a width or a depth can be mainly reduced, thereby the dimension of the apparatus can be reduced in its entirety. Further, since the dimension of the apparatus in the transfer material conveying direction can be reduced, it is also possible to reduce a time for discharging a first transfer material on which an image is formed.

According to another aspect of the present invention, the image forming apparatus (second image forming apparatus) includes:

an image carrier which has a predetermined center of rotation and on which a toner image is formed by developing an electrostatic latent image formed thereon with a toner;

a rotary developing device that has plural developing units, which are disposed about the predetermined center of rotation thereof, and in which respective color toners are accommodated, and develops the electrostatic latent image on the image carrier by a developing unit which is faced to the image carrier by the rotation of the rotary developing device;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material;

a fixing unit which fixes the toner image on the transfer material, which has undergone the transfer of the toner image, thereon at a predetermined fixing position; and a conveying path along which the transfer material passes through the secondary transfer position and the fixing position and which has a partial conveying path extending approximately vertically or approximately horizontally between the secondary transfer position and the fixing position, wherein the primary transfer position is disposed on a side where the approximately flat-shaped intermediate transfer member moves in a direction in which it approaches the secondary transfer position;

the secondary transfer position is disposed upstream of a straight line in a transfer material conveying direction, which is approximately vertical to a direction in which the partial conveying path extends, of a horizontal line and a vertical line that pass through the center of rotation of the image carrier; and the fixing position is disposed upstream of a straight line in the transfer material conveying direction, which passes through the center of rotation of the rotary developing device and the center of rotation of the image carrier.

In the second image forming apparatus of the present invention, the primary transfer position, the secondary transfer position, and the fixing position are disposed at the respective positions described above. Thus, when the partial conveying path extends approximately vertically, a height can be mainly reduced, and when it extends approximately horizontally, a width or a depth can be mainly reduced, thereby the dimension of the apparatus can be reduced in its entirety. Further, since the dimension of the apparatus in the transfer material conveying direction can be reduced, it is also possible to reduce a time for discharging a first transfer material on which an image is formed.

According to another aspect of the present invention, the image forming apparatus (third image forming apparatus) includes:

an image carrier which has a predetermined center of rotation and on which a toner image is formed by developing an electrostatic latent image formed thereon with a toner;

a multi-color developing device which has plural developing units disposed thereon and accommodating respective color toners and develops the electrostatic latent image on the image carrier by a developing unit selected from the plurality of developing units;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material;

a fixing unit which fixes the toner image on the transfer material, which has undergone the transfer of the toner image, thereon at a predetermined fixing position; and a conveying path along which the transfer material passes through the secondary transfer position and the fixing position and which has a partial conveying path extending approximately vertically or approximately horizontally between the secondary transfer position and the fixing position, wherein the primary transfer position is disposed in an intermediate portion on a side where the flat-shaped intermediate transfer member moves in a direction in which it approaches the secondary transfer position;

the secondary transfer position is disposed upstream of a straight line in a transfer material conveying direction, which is approximately vertical to a direction in which the partial conveying path extends, of a horizontal line and a vertical line that pass through the center of rotation of the image carrier; and the fixing position is disposed upstream in the transfer material conveying direction of a straight line, which is approximately vertical to a direction in which the partial conveying path extends, of a horizontal line and a vertical line that are in contact with the most downstream portion of the intermediate transfer member in the conveying direction thereof.

Here, the above multi-color developing device may be a rorary developing device, but not limited to the rorary developing device, and may be plural developing devices that are separately provided for developing an electrostatic latent image on one image carrier.

In the third image forming apparatus of the present invention, since the primary transfer position, the secondary transfer position, and the fixing position are disposed at the respective positions described above, the size of the image forming apparatus can be reduced similarly to the first image forming apparatus.

According to another aspect of the present invention, the image forming apparatus (fourth image forming apparatus) includes:

an image carrier which has a predetermined center of rotation and on which a toner image is formed by developing an electrostatic latent image formed thereon with a toner;

a multi-color developing device which has plural developing units disposed thereon and accommodating respective color toners and develops the electrostatic latent image on the image carrier by a developing unit selected from the plurality of developing units;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material;

a fixing unit which has a pair of rotating members, clamps the transfer material, onto which the toner image has been transferred, between the pair of rotating members at a predetermined fixing position, and fixes the toner image on the transfer material; and a conveying path along which the transfer material passes through the secondary transfer position and the fixing position and which has a partial conveying path extending approximately vertically or approximately horizontally between the secondary transfer position and the fixing position, wherein the image carrier is disposed at a position at which it is in contact with the approximately flat-shaped intermediate transfer member on the side thereof where the intermediate transfer member moves in a direction in which it approaches the secondary transfer position as well as the image carrier is disposed downstream of a first straight line which is approximately vertical to a direction, in which the partial conveying path extends, of a horizontal line and a vertical line that are in contact with a portion of the intermediate transfer member on the most upstream side thereof in a transfer material conveying direction, the pair of rotating members are disposed upstream of a second straight line which is approximately vertical to the direction, in which the partial conveying path, of a horizontal line and a vertical line that are in contact with a portion of the intermediate transfer member on the most downstream side thereof in the transfer material conveying direction.

In the fourth image forming apparatus of the present invention, the image carrier and the pair of rotating members that constitute the fixing unit are disposed at the respective positions described above, the size of the image forming apparatus can be reduced similarly to the first and second image forming apparatuses.

According to another aspect of the present invention, the image forming apparatus (fifth image forming apparatus) includes:

an image carrier which has a predetermined center of rotation and on which a toner image is formed by developing an electrostatic latent image formed thereon with a toner;

a multi-color developing device which has plural developing units disposed thereon and accommodating respective color toners and develops the electrostatic latent image on the image carrier by a developing unit selected from the plurality of developing units;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material;

a fixing unit which fixes the toner image on the transfer material, which has undergone the transfer of the toner image, thereon at a predetermined fixing position; and a conveying path along which the transfer material passes through the secondary transfer position and the fixing position and has a partial conveying path extending approximately vertically or approximately horizontally between the secondary transfer position and the fixing position;

wherein the intermediate transfer member is disposed so as to incline at an inclining angle of 30° or more to 50° or less with respect to a straight line which extends approximately in parallel with a direction in which the partial conveying path extends, of a horizontal line and a vertical line;

the image carrier is disposed on a side where the approximately flat-shaped intermediate transfer member moves in a direction in which the intermediate transfer member approaches the secondary transfer position; and the secondary transfer position is disposed upstream of a straight line in a transfer material conveying direction, which is approximately vertical to a direction in which the partial conveying path extends, of a horizontal line and a vertical line which pass through the center of rotation of the image carrier.

In the fifth image forming apparatus of the present invention, since the intermediate transfer member, the image carrier, and the second transfer position are disposed at the respective positions described above, the size of the image forming apparatus can be reduced similarly to the first to third image forming apparatuses.

Here, the intermediate transfer member inclines at an angle of 30° or more to 50° or less with respect to a straight line extending in parallel with the direction in which the partial conveying path extends. When the inclining angle is smaller than 30°, there may occur an accident that the transfer material, which has passed through the secondary transfer position, comes into intimate contact with the intermediate transfer member and cannot be exfoliated therefrom because an exfoliating angle of the transfer material is too small. Further, when the inclining angle exceeds 50°, the image carrier and the multi-color developing device are greatly separated from the partial conveying path, which makes it difficult to reduce the size of the image forming apparatus.

According to another aspect of the present invention, the image forming apparatus (sixth image forming apparatus) includes:

an image carrier which has a predetermined center of rotation and on which a toner image is formed by developing an electrostatic latent image formed thereon with a toner;

a rotary developing device that has plural developing units, which are disposed about the predetermined center of rotation thereof, and in which respective color toners are accommodated, and develops the electrostatic latent image formed on the image carrier by a developing unit which is faced to the image carrier by the rotation of the rotary developing device;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material;

a fixing unit which fixes the toner image on the transfer material, which has undergone the transfer of the toner image, thereon at a predetermined fixing position;

a transfer material accommodation unit that accommodates transfer materials; and a conveying path along which the transfer material, which has been fed from the transfer material accommodation unit, passes through the secondary transfer position and the fixing position and has a partial conveying path extending approximately vertically or approximately horizontally between the secondary transfer position and the fixing position, wherein the primary transfer position is disposed on a side where the approximately flat-shaped intermediate transfer member moves in a direction in which the intermediate transfer member approaches the secondary transfer position;

the secondary transfer position and the fixing position are disposed upstream and downstream in a sheet conveying direction of a straight line, respectively which is approximately vertical to a direction in which the partial conveying path extends, of a horizontal line and a vertical line which pass through the center of rotation of the rotary developing device; and the center of rotation of the rotary developing device is disposed in the vicinity of a straight line, which extends in a direction parallel with the direction in which the partial conveying path extends, of a horizontal line and a vertical line that pass through a transfer material accommodated in the transfer material accommodation unit at a point thereof disposed one half the length of the transfer material in a direction in which it is fed from the transfer material accommodation unit.

In the sixth image forming apparatus, since the primary transfer position, the secondary transfer position, the fixing position, and the rotary developing device are disposed at the respective positions described above, the size of the image forming apparatus can be reduced similarly to the second to fifth image forming apparatus.

According to another aspect of the present invention, the image forming apparatus (seventh image forming apparatus) includes:

an image carrier which has a predetermined center of rotation and on which a toner image is formed by developing an electrostatic latent image formed thereon with a toner;

a rotary developing device that has plural developing units, which are disposed about the predetermined center of rotation thereof, and in which respective color toners are accommodated, and develops the electrostatic latent image on the image carrier by a developing unit which is faced to the image carrier by the rotation of the rotary developing device;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material, a fixing unit which fixes the toner image on the transfer material, which has undergone the transfer of the toner image, thereon at a predetermined fixing position;

a conveying path along which the transfer material passes through the secondary transfer position and the fixing position approximately vertically toward a discharge unit disposed in an upper portion of the image forming apparatus;

discharge members that discharge the transfer material toward the discharge unit;

a first support roll that supports the intermediate transfer member from the inside thereof at the secondary transfer position; and a second support roll that supports the intermediate transfer member from the inside thereof at a position on the upstream side of the secondary transfer position in a moving direction of the intermediate transfer member and forms a short side of the approximately flat-shaped intermediate transfer member which extends upstream of the transfer material conveying direction in cooperation with the first support roll, wherein the intermediate transfer member is disposed so as to incline downstream in a sheet conveying direction;

the image carrier is disposed in contact with a side of the approximately flat-shaped intermediate transfer member where the intermediate transfer member moves in a direction in which it approaches the second support;

the overall image carrier is disposed downstream of a first horizontal line with which the intermediate transfer member comes into contact at the most upstream side portion thereof in the sheet conveying direction;

the overall image carrier is disposed nearer to the partial conveying path than a vertical line with which the intermediate transfer member comes into contact at the portion thereof farthest from the partial conveying path;

the discharge members are disposed downstream in the transfer material conveying direction of a second horizontal line that is in contact with the most downstream portion of the intermediate transfer member in the transfer material conveying direction; and at least a part of the discharge unit is disposed upstream of the second horizontal line in the sheet conveying direction.

In the seventh image forming apparatus of the present invention, since the portion between the first and second support rolls are supported flatly, it is not necessary to greatly curve the transfer material conveying path, and thus a space larger than necessary is not required in the portion below the secondary transfer position, which will contribute to reducing the size of the image forming means as a first point. Further, the discharge members are disposed downstream in the transfer material conveying direction of the second horizontal line that is in contact with the most downstream portion of the intermediate transfer member in the transfer material conveying direction, and at least a part of the discharge unit is disposed upstream of the second horizontal line in the sheet conveying direction. Accordingly, even if the height of the image forming apparatus, in which the most downstream portion of the intermediate transfer member in the sheet conveying direction is accommodated, is more increased by a cover and the like of the image forming apparatus, the height of the overall image forming apparatus can be suppressed as mush as possible as well as a discharged transfer material accommodation unit, in which discharged sheets are accommodated, can be disposed at a position as low as possible. As a result, the components above the secondary transfer position can be disposed in a space as small as possible, which will contribute to reducing the size of the image forming apparatus as a second point.

As described above, according to the layouts of the image forming apparatuses of the present invention, small image forming apparatuses can be realized.

BRIEF DESCRIPTION OF THE DRAWINGS

Preferred embodiments of the present invention will be described in detail based on the following figures, wherein.

DESCRIPTION OF THE PREFERRED EMBODIMENTS

Various embodiments of the present invention will be explained below.

Figure 1A:
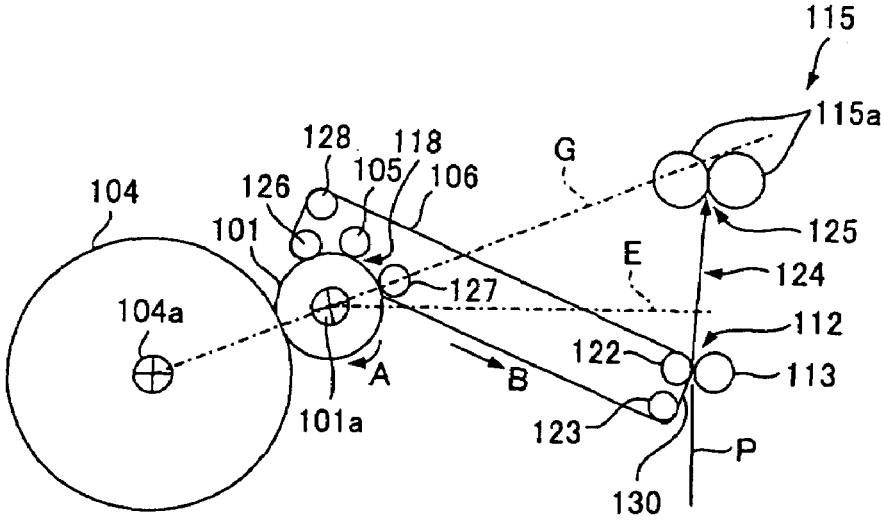
FIGS. 1A and 1B are schematic views showing a layout of leading components in a first embodiment of an image forming apparatus of the present invention.
Figure 1B:
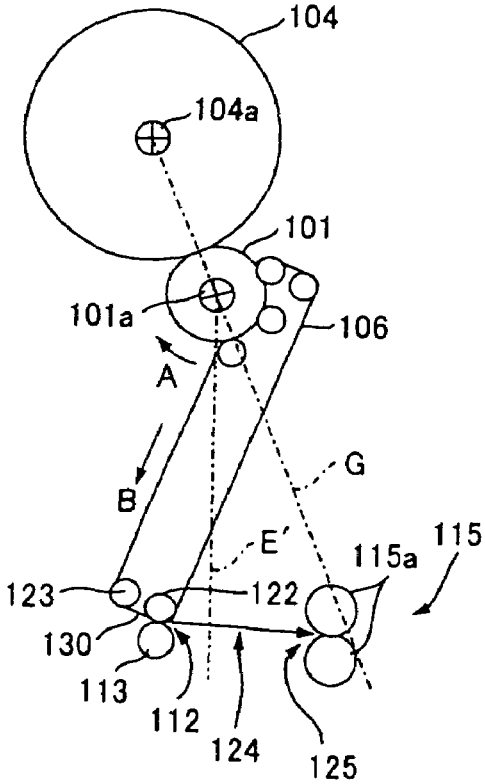

FIGS. 1A to 1B are schematic views showing a layout of leading components in a first embodiment of the image forming apparatus of the present invention. FIG. 1A shows an example of a layout in which a partial convening path 124 extends approximately vertically between a secondary transfer position 112 and a fixing position 125 (hereinafter, the example that the partial convening path 124 extends approximately vertically will be referred to as a "horizontal type"), and FIG. 1B shows an example of a layout in which the partial convening path 124 extends approximately horizontally between the secondary transfer position 112 and the fixing position 125 (hereinafter, the example that the partial convening path 124 extends approximately horizontally will be referred to as a "vertical type").

The image forming apparatus has a photosensitive drum 101 disposed therein, an electrostatic latent image is formed on the photosensitive drum 101 while it is rotated about the center of rotation 101*a* thereof in the direction of an arrow A, and a toner image is formed by developing the electrostatic latent image with toners.

Further, the image forming apparatus has a rotary developing device 104 disposed therein. The rotary developing device 104 has four developing units (not shown), which are disposed about the center of rotation 104*a* thereof and in which toners of respective colors C, M, Y, K are accommodated, and when the rotary developing device 104 is rotated, the electrostatic latent image on the photosensitive drum 101 is developed by a developing unit facing the drum.

Further, an intermediate transfer belt 106 is disposed in the image forming apparatus. The intermediate transfer belt 106 is formed in an approximately flat shape, disposed obliquely with respect to the partial conveying path 124, circulatingly moves in the direction of an arrow B. The toner image formed on the photosensitive drum 101 is transferred onto the intermediate transfer belt 106 by the action of a transfer unit 105 at the primary transfer position 118, and the toner image is secondarily transferred onto a sheet P at the secondary transfer position 112 by the action of a transfer unit 113, the sheet P being conveyed to the secondary transfer position 112 through a not shown conveying path.

A first support roll 122, which supports the intermediate transfer belt 106 from the inside thereof, is disposed at the secondary transfer position 112. Further, a second support roll 123 is disposed upstream of the secondary transfer position 112 in the moving direction of the intermediate transfer belt (the direction of the arrow B). The second support roll 123 supports the intermediate transfer belt 106 from the inside thereof and forms a short side in the portion of the approximately flat-shaped intermediate transfer belt 106 between the second support roll 123 and the secondary transfer position 112 in cooperation with the first support roll 122. The short side is a plane that determines an angle of the sheet traveling to the secondary transfer position 112, and the plane is called a transfer plane 130.

Further, the photosensitive drum 101 is disposed on a long side portion of the intermediate transfer belt 106 (upstream of the secondary transfer position 112) where the belt 106 moves in a direction in which it approaches the second support roll 123 or the secondary transfer position 112. Moreover, in the example shown in FIG. 1, the photosensitive drum 101 is disposed in contact with the intermediate transfer belt 106 over a predetermined region in the moving direction of the intermediate transfer belt (the direction shown by the arrow B) about the primary transfer position 118. The intermediate transfer belt 106 is pressed against the photosensitive drum 101 by support rolls 126 and 127 on both the sides of the region thereof where it is in contact with the photosensitive drum 101.

The intermediate transfer belt 106 circulatingly moves. That is, the belt 106 passes through the secondary transfer position 112 at which it is supported by the first support roll 122 from the inside thereof, advances obliquely in a direction in which it departs from the partial conveying path 124 and changes its moving direction through a support roll 128, further changes its moving direction through the support. roll 126 as well as is pressed against the photosensitive drum 101, passes through the primary transfer position 118 at which the transfer unit 105 is disposed, passes through the additional support roll 127 that presses the belt 106 against the photosensitive drum 101, changes its moving direction through the second support roll 123 as well as forms the transfer plane 130 through the first and second support rolls 122 and 123, and returns to the secondary transfer position 112 at which it is supported by the first support roll 122 again.

It should be noted that when a color image is formed, the transfer unit 113, which is disposed at the secondary transfer position 112, is separated from intermediate transfer belt 106 until toner images of four colors CMYK are formed on the intermediate transfer belt 106. When toner members of four colors are sequentially formed on the photosensitive drum 101, toner images of the four colors are sequentially transferred onto the intermediate transfer belt 106 primarily, and a toner image composed of the four colors are formed on the intermediate transfer belt 106 thereby, the transfer unit 113 comes into contact with the intermediate transfer belt 106, and the toner image of the four colors is secondarily transferred onto the sheet P at a time.

The sheet P, which has undergone the transfer of the toner image, reaches a fixing unit 115 passing through the partial conveying path 124 between the secondary transfer position 112 and the fixing position 125, is clamped between a pair of fixing rolls 115*a* constituting the fixing unit 115, and heated and pressurized therebetween, thereby the toner image formed on the sheet is fixed thereon at the fixing position 125 between the pair of fixing rolls 115*a*, and a color image composed of the fixed toner image is formed on the sheet.

The sheet, on which the color image has been fixed, is discharged externally of the image forming apparatus passing through a path that is not shown in FIGS. 1A and 1B.

In the first embodiment shown in FIGS. 1A and 1B, the primary transfer position 118 is disposed on the side where the approximately flat-shaped intermediate transfer belt 106 moves in the direction in which it approaches the secondary transfer position 112, as described above.

Further, in the first embodiment, the secondary transfer position 112 is disposed upstream a straight line in a sheet conveying direction (a horizontal line E in the horizontal type shown in FIG. 1A, and a vertical line E' in the vertical type shown in FIG. 1B) which is approximately vertical to a direction in which the partial conveying path 124 extends (an approximately vertical direction in FIG. 1A and an approximately horizontal direction in FIG. 1B) of a horizontal line and a vertical line that pass through the center rotation 101*a* of the photosensitive drum 101, that is, the secondary transfer position 112 is disposed below the horizontal line E in the horizontal type shown in FIG. 1A and is disposed at a position apart from the fixing rolls 115*a* across the vertical line E' in the vertical type shown in FIG. 1B.

Further, in the first embodiment, the fixing position 125 is disposed upstream of a straight line G passing through the center of rotation 104*a* of the rotary developing device 104 and the center of rotation 101*a* of the photosensitive drum 101 in the sheet conveying direction.

As described above, in the first embodiment shown in FIG. 1, the primary transfer position 118 is disposed upstream of the secondary transfer position 112 of the intermediate transfer belt 106, and the secondary transfer position 112 and the fixing position 125 are disposed at the above respective positions, that is, at positions which are upstream of the sheet conveying path as far as possible. Accordingly, it is particularly possible to reduce a height in the horizontal type shown in FIG. 1A and to reduce a width or a depth (a right to left dimension in FIG. 1B) in the vertical type shown in FIG. 1B.

Figure 2A:
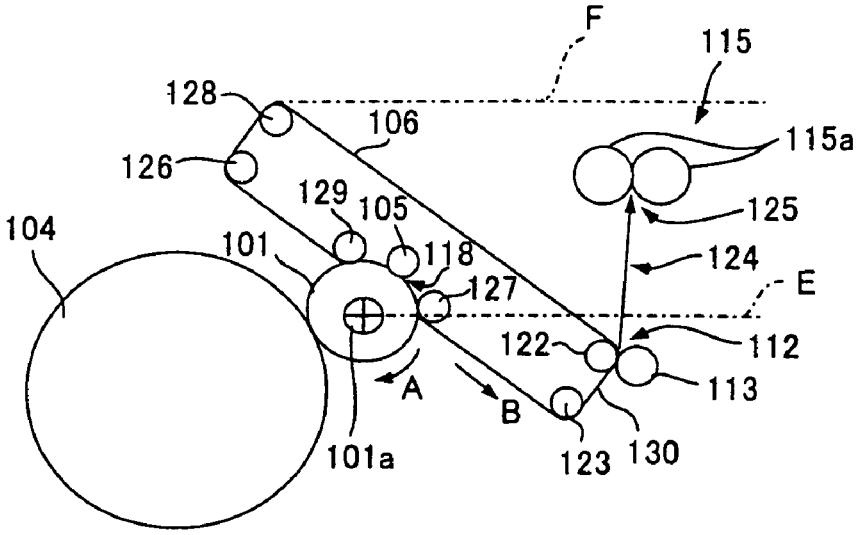
FIGS. 2A and 2B are schematic views showing a layout of leading components in a second embodiment of the image forming apparatus of the present invention.
Figure 2B:
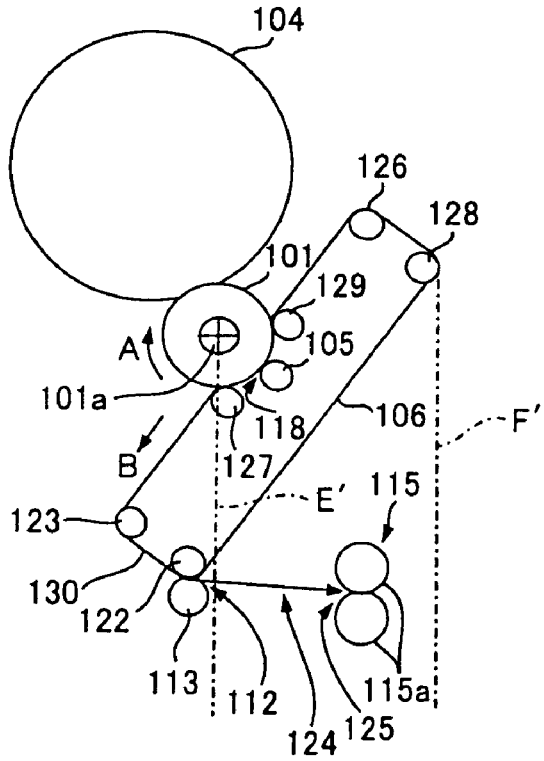

FIGS. 2A and 2B are schematic views showing a layout of leading components in a second embodiment of the image forming apparatus of the present invention. A difference between the second embodiment and the first embodiment shown in FIGS. 1A and 1B will be explained.

The primary transfer position 118 is disposed approximately at the center of the portion of the intermediate transfer belt 106 that where the belt 106 moves in the direction in which it approaches the secondary transfer position 112, and the photosensitive drum 101 is disposed in a state that it is in contact with the intermediate transfer belt 106 over a predetermined region including the primary transfer position 118 of the photosensitive drum 101 in the moving direction of the intermediate transfer belt. Accordingly, the support roll 126 shown in FIG. 2 assumes only a role of changing the moving direction of the intermediate transfer belt 106, although the support roll 126 shown in FIG. 1 assumes both a role of changing the moving direction of the intermediate transfer belt 106 and a role of pressing the intermediate transfer belt 106 against the intermediate transfer belt 106. Thus, in the second embodiment, a support roll 129 is disposed separately from the support roll 126 and assumes a role of pressing the intermediate transfer belt 106 against the photosensitive drum 101.

Although FIGS. 2A and 2B show the rotary developing device 104 as a developing device, it is not always necessary that the developing device be the rotary developing device 104, and various types of multi-color developing units, which will be described with reference to, for example, FIG. 18, may be employed.

As described above, in the second embodiment shown in FIGS. 2A and 2B, the primary transfer position 118 is disposed approximately at the intermediate portion of the intermediate transfer belt 106 which moves in the direction in which it approaches the secondary transfer position 112, that is, in the intermediate portion of the intermediate transfer belt 106 upstream of the secondary transfer position 112 in the moving direction of the belt 106 (the direction of an arrow B).

Further, in the second embodiment, the secondary transfer position 112 is disposed upstream of a straight line in the sheet conveying direction (a horizontal line E in the horizontal type shown in FIG. 2A, and a vertical line E' in the vertical type in FIG. 2B), which is vertical to a direction in which the partial conveying path 124 extends (an approximately vertical direction in the horizontal type shown in FIG. 1A, and an approximately horizontal direction in the vertical type shown in FIG. 2B) of a horizontal line and a vertical line that pass through the center of rotation 101*a* of the photosensitive drum 101.

Further, in the second embodiment, the fixing position 125 is disposed upstream of a straight line in the sheet conveying direction (a horizontal line F in FIG. 2A, and a vertical line F' in FIG. 2B), which is approximately vertical to the direction in which the partial conveying path 124 extends, of a horizontal line and a vertical line, which are in contact with the most downstream portion of the intermediate transfer belt 106 in the sheet conveying direction (the upper side portion in FIG. 2A, and the right side portion in FIG. 2B), that is, the fixing position 125 is disposed below the horizontal line F in FIG. 2A and is disposed on the left side of the vertical line F' in FIG. 2B.

When the above conditions are satisfied, it is also possible to reduce a height in the horizontal type of FIG. 2A and to reduce a width or a depth (a right to left dimension in FIG. 2B) in the vertical type of FIG. 2B, which will contribute to reducing the size of the image forming apparatus.

Figure 3A:
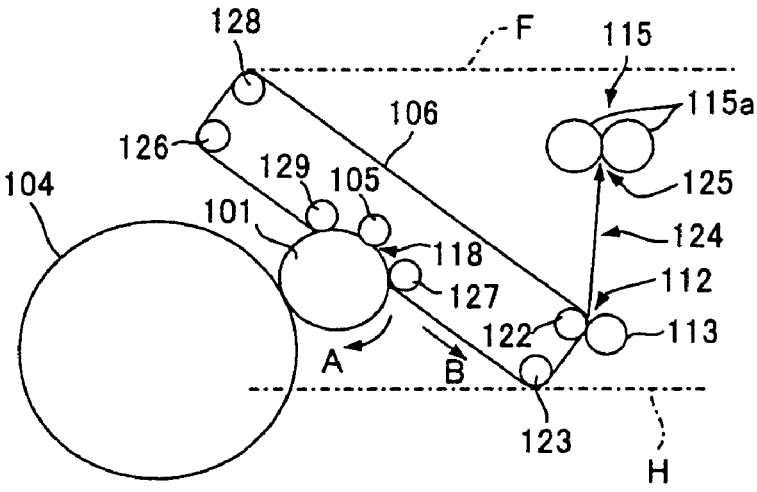
FIGS. 3A and 3B are schematic views showing a layout of leading components in a third embodiment of the image forming apparatus of the present invention.
Figure 3B:
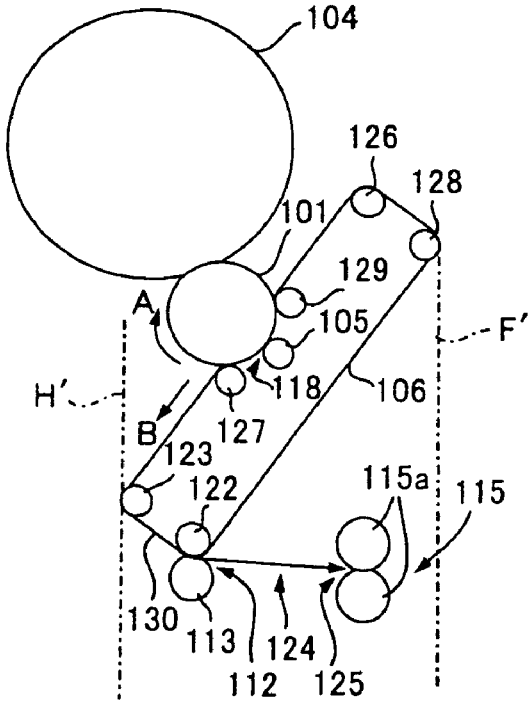

FIGS. 3A and 3B are schematic views showing a layout of leading components in a third embodiment of the image forming apparatus of the present invention. Since the construction and the arrangement of the respective components shown in FIGS. 3A and 3B are the same as those of FIGS. 2A and 2B, the explanation thereof is omitted.

In the third embodiment shown in FIGS. 3A and 3B, the photosensitive drum 101 is disposed at a position at which it is in contact with the approximately flat-shaped intermediate transfer belt 106 on the side thereof where the belt 106 moves in a direction in which it approaches the secondary transfer position 112, that is, at a position at which the photosensitive drum 101 is in contact with a portion of the intermediate transfer belt 106 upstream of the secondary transfer position 112 in the moving direction of the belt 106. In addition, the photosensitive drum 101 is disposed downstream of a first straight line (a horizontal line H in the horizontal type shown in FIG. 3A, and a vertical line H' in the vertical type shown in FIG. 3B) which is approximately vertical to a direction, in which the partial conveying path 124 extends, of a horizontal line and a vertical line that are in contact with a portion of the intermediate transfer belt 106 on the most upstream side thereof in the sheet conveying direction.

Further, in the third embodiment, the pair of fixing rolls 115*a* constituting the fixing unit 115 are disposed upstream of a second straight line (a horizontal line F in the horizontal type shown in FIG. 3A, and a vertical line F' in the vertical type shown in FIG. 3B) which is approximately vertical to a direction, in which the partial conveying path 124 extends, of a horizontal line and a vertical line that are in contact with a portion of the intermediate transfer belt 106 on the most downstream side thereof in the sheet conveying direction.

When the above conditions are satisfied, it is also possible to reduce a height in the horizontal type of FIG. 3A and to reduce a width or a depth (a right to left dimension in FIG. 3B) in the vertical type of FIG. 3B similarly to the image forming apparatuses shown in FIGS. 1 and 2, which will contribute to reducing the size of the image forming apparatus.

Figure 4A:
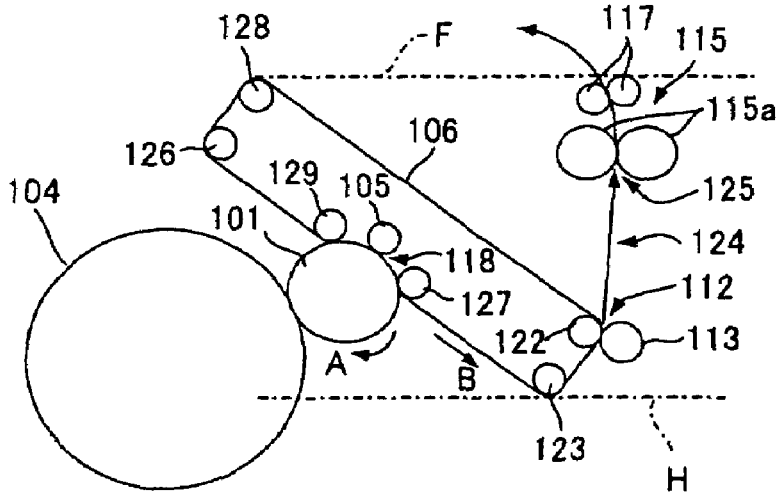
FIGS. 4A and 4B are schematic views showing a layout of leading components in a fourth embodiment of the image forming apparatus of the present invention.
Figure 4B:
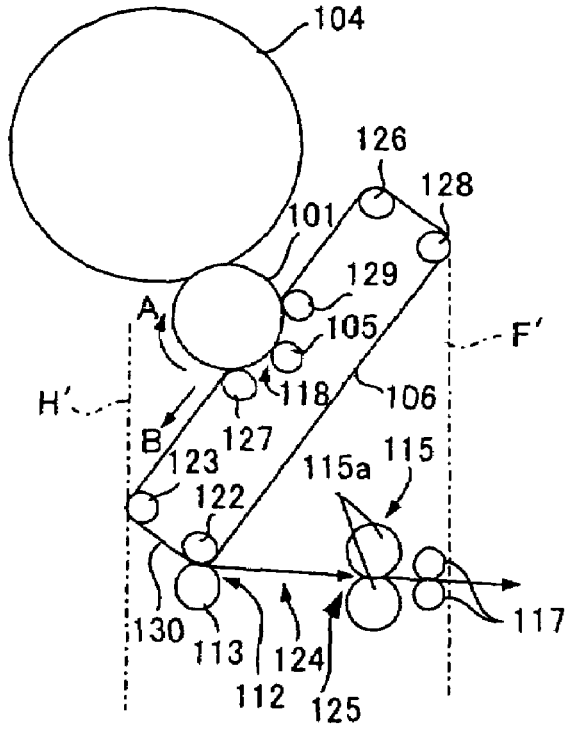

FIGS. 4A and 4B are schematic views showing a layout of leading components in a fourth embodiment of the image forming apparatus of the present invention. A difference between the fourth embodiment and the third embodiment shown in FIGS. 3A and 3B will be explained.

FIGS. 4A and 4B show sheet discharge rolls 117 disposed downstream of the pair of fixing rolls 115*a* constituting the fixing unit 115 in the sheet conveying direction, and the sheet discharge rolls 117 discharge the sheet, on which the toner image is fixed by the fixing unit 115, externally of the image forming apparatus.

In the fourth embodiment shown in FIGS. 4A and 4B, the photosensitive drum 101 is disposed at a position at which it is in contact with the intermediate transfer belt 106 on the side thereof where the belt 106 moves in a direction in which it approaches the secondary transfer position 112 as well as the photosensitive drum 101 is disposed downstream of a first straight line (a horizontal line H in the horizontal type shown in FIG. 4A, and a vertical line H' in the vertical type shown in FIG. 4B) which is approximately vertical to a direction, in which the partial conveying path 124 extends, of a horizontal line and a vertical line that are in contact with a portion of the intermediate transfer belt 106 on the most upstream side thereof in the sheet conveying direction, similarly to the third embodiment shown in FIGS. 3A and 3B. In addition to the above arrangement, the fixing rolls 115*a* constituting the fixing unit 115 are disposed upstream of a second vertical line (a horizontal line F in the horizontal type shown in FIG. 4A, and a vertical line F' in the vertical type shown in FIG. 4B) which is approximately vertical to a direction, in which the partial conveying path 124 extends, of a horizontal line and a vertical line that are in contact with a portion of the intermediate transfer belt 106 on the most downstream side thereof in the sheet conveying direction.

In addition to the above arrangements, in the fourth embodiment, the sheet discharge rolls 117 are also disposed upstream of the second vertical line in the sheet conveying direction (the horizontal line F in the horizontal type shown in FIG. 4A, and the vertical line F' in the vertical type shown in FIG. 4B).

In this case, it is possible to more reduce a height in the horizontal type of FIG. 4A and to more reduce a width or a depth (a right to left dimension in FIG. 4B) in the vertical type of FIG. 4B, which will contribute to more reducing the size of the image forming apparatus.

Figure 5A:
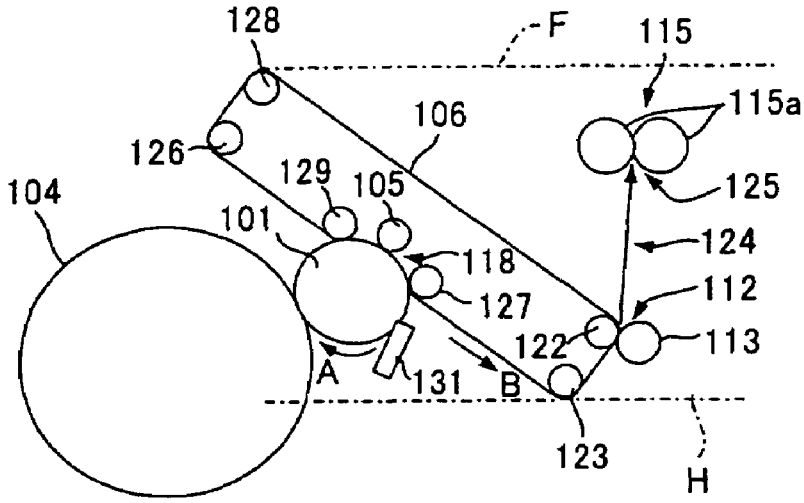
FIGS. 5A and 5B are schematic views showing a layout of leading components in a fifth embodiment of the image forming apparatus of the present invention.
Figure 5B:
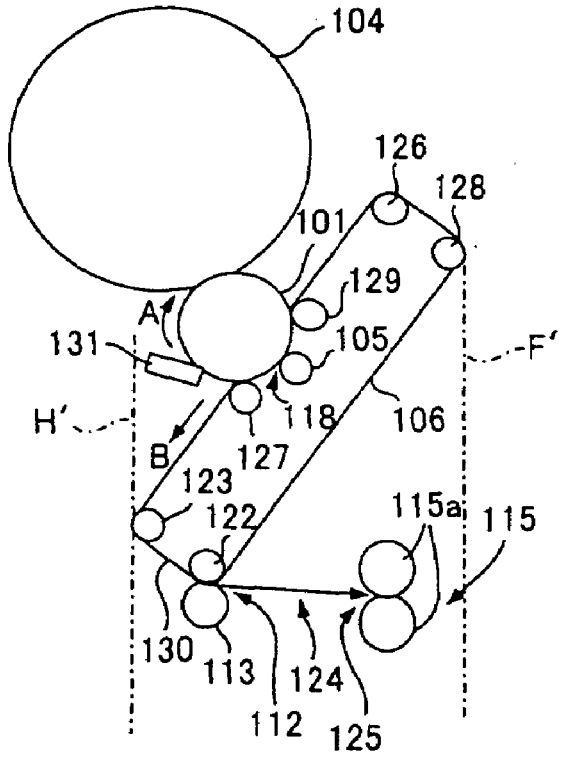

FIGS. 5A and 5B are schematic views showing a layout of leading components in a fifth embodiment of the image forming apparatus of the present invention. A difference between the fifth embodiment and the third embodiment shown in FIGS. 3A and 3B will be explained.

In FIGS. 5A and 5B, the image forming apparatus includes a cleaning member 131 that is in sliding contact with the photosensitive drum 101 downstream of the portion of the photosensitive drum 101, at which it faces the primary transfer position 118, in the rotating direction thereof (the direction of an arrow A), and the cleaning member 131 cleans the photosensitive drum 101.

In the fifth embodiment shown in FIGS. 5A and 5B, the photosensitive drum 101 is disposed at a position at which it is in contact with the intermediate transfer belt 106 on the side thereof where the belt 106 moves in a direction in which it approaches the secondary transfer position 112 as well as the photosensitive drum 101 is disposed downstream of a first straight line (a horizontal line H in the horizontal type shown in FIG. 5A, and a vertical line H' in the vertical type shown in FIG. 5B) which is approximately vertical to a direction, in which the partial conveying path 124 extends, of a horizontal line and a vertical line that are in contact with a portion of the intermediate transfer belt 106 on the most upstream side thereof in the sheet conveying direction, similarly to the third embodiment shown in FIGS. 3A and 3B. In addition to the above arrangement, the fixing rolls 115*a* constituting the fixing unit 115 are disposed upstream of a second vertical line (a horizontal line F in the horizontal type shown in FIG. 5A, and a vertical line F' in the vertical type shown in FIG. 5B) which is approximately vertical to a direction, in which the partial conveying path 124 extends, of a horizontal line and a vertical line that are in contact with a portion of the intermediate transfer belt 106 on the most downstream side thereof in the sheet conveying direction, similarly to the third embodiment shown in FIGS. 3A and 3B.

In addition to the above arrangements, in the fifth embodiment, the cleaning member 131 is disposed downstream of the first straight line (the horizontal line H in the horizontal type shown in FIG. 5A, and the vertical line H' in the vertical type shown in FIG. 5B) in the sheet conveying direction.

When the above conditions are satisfied, it is possible to more reduce a height in the horizontal type of FIG. 5A and to more reduce a width or a depth (a right to left dimension in FIG. 5B) in the vertical type of FIG. 5B, which will contribute to more reducing the size of the image forming apparatus.

Figure 6A:
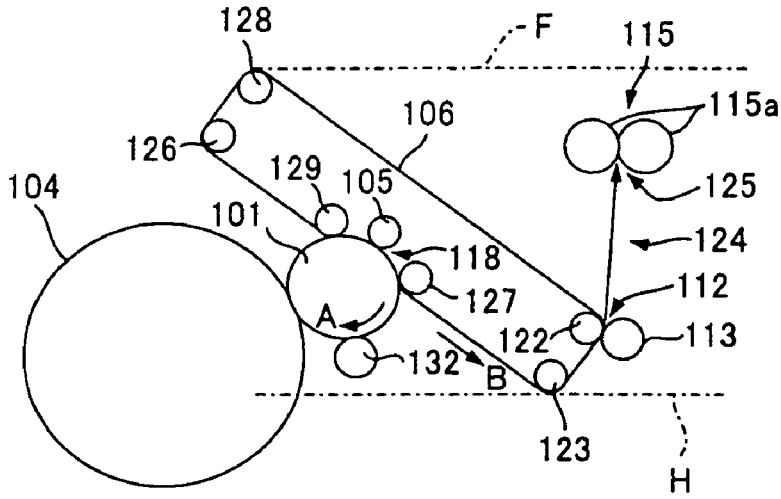
FIGS. 6A and 6B are schematic views showing a layout of leading components in a sixth embodiment of the image forming apparatus of the present invention.
Figure 6B:
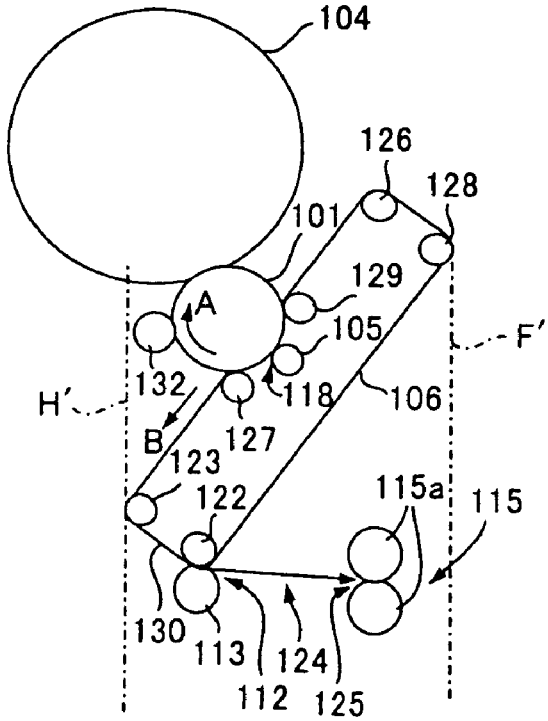

FIGS. 6A and 6B are schematic views showing a layout of leading components in a sixth embodiment of the image forming apparatus of the present invention. A difference between the sixth embodiment and the third embodiment shown in FIGS. 3A and 3B will be explained.

In FIGS. 6A and 6B, the image forming apparatus includes a charge member 132 which charges a portion of the photosensitive drum 101 before an electrostatic latent image is formed in the portion.

In the sixth embodiment shown in FIGS. 6A and 6B, the photosensitive drum 101 is disposed at a position at which it is in contact with the intermediate transfer belt 106 on the side thereof where the belt 106 moves in a direction in which it approaches the secondary transfer position 112 as well as the photosensitive drum 101 is disposed downstream of a first straight line (a horizontal line H in the horizontal type shown in FIG. 6A, and a vertical line H' in the vertical type shown in FIG. 6B) which is approximately vertical to a direction, in which the partial conveying path 124 extends, of a horizontal line and a vertical line that are in contact with a portion of the intermediate transfer belt 106 on the most upstream side thereof in the sheet conveying direction, similarly to the third embodiment shown in FIGS. 3A and 3B. In addition to the above arrangement, the fixing rolls 115*a* constituting the fixing unit 115 are disposed upstream of a second vertical line (a horizontal line F in the horizontal type shown in FIG. 6A, and a vertical line F' in the vertical type shown in FIG. 6B) which is approximately vertical to a direction, in which the partial conveying path 124 extends, of a horizontal line and a vertical line that are in contact with a portion of the intermediate transfer belt 106 on the most downstream side thereof in the sheet conveying direction.

In addition to the above arrangements, in the sixth embodiment, the charge member 132 is disposed downstream of the first straight line (the horizontal line H in the horizontal type shown in FIG. 6A, and the vertical line H' in the vertical type shown in FIG. 6B) in the sheet conveying direction.

In this case, it is also possible to more reduce a height in the horizontal type of FIG. 6A and to more reduce a width or a depth (a right to left dimension in FIG. 6B) in the vertical type of FIG. 6B, which will contribute to more reducing the size of the image forming apparatus.

Figure 7A:
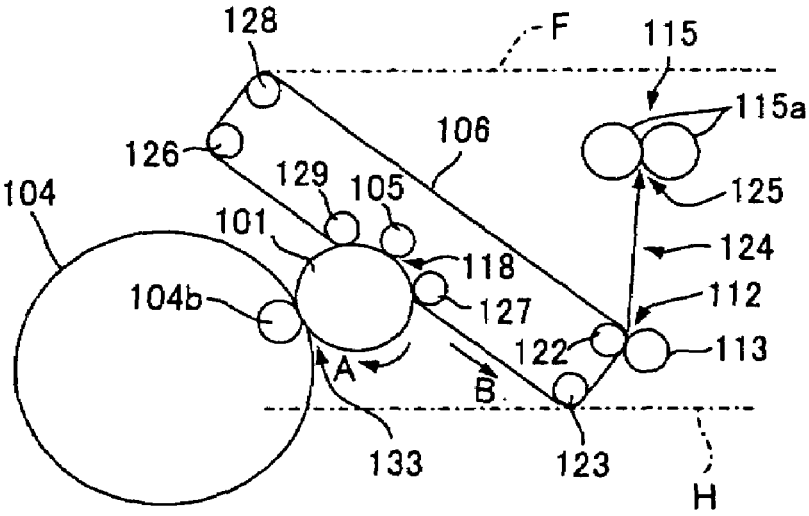
FIGS. 7A and 7B are schematic views showing a layout of leading components in a seventh embodiment of the image forming apparatus of the present invention.
Figure 7B:
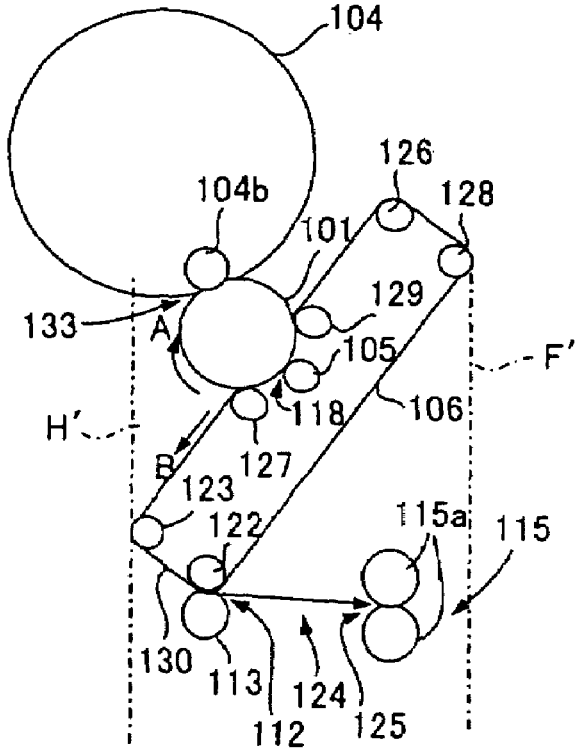

FIGS. 7A and 7B are schematic views showing a layout of leading components in a seventh embodiment of the image forming apparatus of the present invention. A difference between the seventh embodiment and the third embodiment shown in FIGS. 3A and 3B will be explained.

In the seventh embodiment shown in FIGS. 7A and 7B, the photosensitive drum 101 is disposed at a position at which it is in contact with the intermediate transfer belt 106 on the side thereof where the belt 106 moves in a direction in which it approaches the secondary transfer position 112 as well as the photosensitive drum 101 is disposed downstream of a first straight line (a horizontal line H in the horizontal type shown in FIG. 7A, and a vertical line H' in the vertical type shown in FIG. 7B) which is approximately vertical to a direction, in which the partial conveying path 124 extends, of a horizontal line and a vertical line that are in contact with a portion of the intermediate transfer belt 106 on the most upstream side thereof in the sheet conveying direction, similarly to the third embodiment shown in FIGS. 3A and 3B. In addition to the above arrangement, the fixing rolls 115*a* constituting the fixing unit 115 are disposed upstream of a second vertical line (a horizontal line F in the horizontal type shown in FIG. 7A, and a vertical line F' in the vertical type shown in FIG. 7B) which is approximately vertical to a direction, in which the partial conveying path 124 extends, of a horizontal line and a vertical line that are in contact with a portion of the intermediate transfer belt 106 on the most downstream side thereof in the sheet conveying direction.

In addition to the above arrangements, in the seventh embodiment, a developing position 133, at which is disposed a developing roll 104*b*, which constitutes the rotary developing device 104 and is in charge of development of an electrostatic latent image on the photosensitive drum 101 this time, is disposed downstream the first straight line (the horizontal line H in the horizontal type shown in FIG. 7A, and the vertical line H' in the vertical type shown in FIG. 7B) in the sheet conveying direction. The developing roll 104*b* rotates while carrying a toner on the surface thereof and conveying the toner to a developing position at which the electrostatic latent image on the photosensitive drum 101 is developed by the toner.

In this case, it is possible to more reduce a height in the horizontal type of FIG. 7A and to more reduce a width or a depth (a right to left dimension in FIG. 7B) in the vertical type of FIG. 7B, which will contribute to more reducing the size of the image forming apparatus.

Figure 8A:
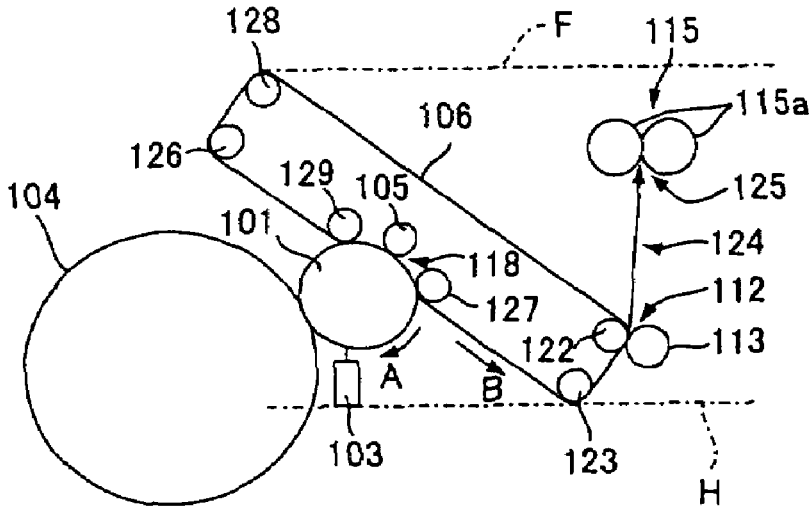
FIGS. 8A and 8B are schematic views showing a layout of leading components in an eighth embodiment of the image forming apparatus of the present invention.
Figure 8B:
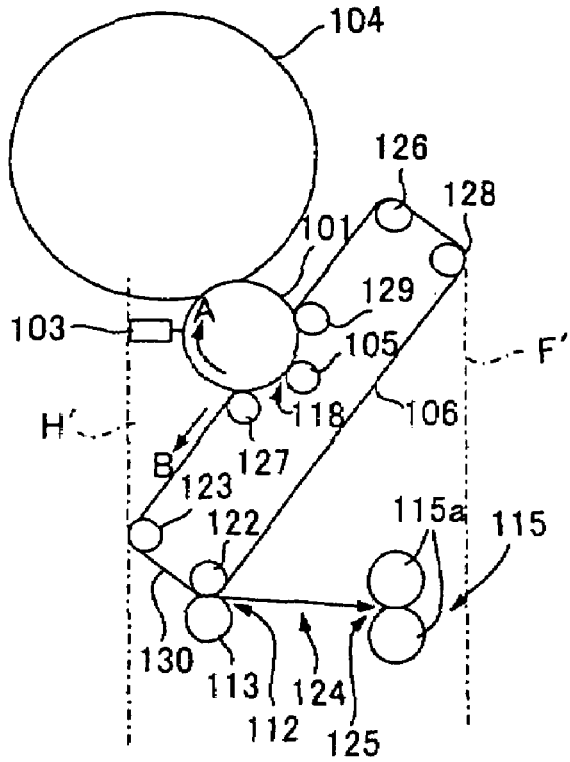

FIGS. 8A and 8B are schematic views showing a layout of leading components in an eighth embodiment of the image forming apparatus of the present invention. A difference between the eighth embodiment and the third embodiment shown in FIGS. 3A and 3B will be explained.

FIGS. 8A and 8B show an exposure unit 103 that forms an electrostatic latent image on the photosensitive drum 101 by exposing the photosensitive drum.

In the eighth embodiment shown in FIGS. 8A and 8B, the photosensitive drum 101 is disposed at a position at which it is in contact with the intermediate transfer belt 106 on the side thereof where the belt 106 moves in a direction in which it approaches the secondary transfer position 112 as well as the photosensitive drum 101 is disposed downstream of a first straight line (a horizontal line H in the horizontal type shown in FIG. 8A, and a vertical line H' in the vertical type shown in FIG. 8B) which is approximately vertical to a direction, in which the partial conveying path 124 extends, of a horizontal line and a vertical line that are in contact with a portion of the intermediate transfer belt 106 on the most upstream side thereof in the sheet conveying direction, similarly to the third embodiment shown in FIGS. 3A and 3B. In addition to the above arrangement, the fixing rolls 115*a* constituting the fixing unit 115 are disposed upstream of a second vertical line (a horizontal line F in the horizontal type shown in FIG. 8A, and a vertical line F' in the vertical type shown in FIG. 8B) which is approximately vertical to a direction, in which the partial conveying path 124 extends, of a horizontal line and a vertical line that are in contact with a portion of the intermediate transfer belt 106 on the most downstream side thereof in the sheet conveying direction.

In addition to the above arrangements, in the eighth embodiment, the exposure unit 103 is disposed downstream of the first straight line (the horizontal line H in the horizontal type shown in FIG. 8A, and the vertical line H' in the vertical type shown in FIG. 8B) in the sheet conveying direction.

In this case, it is also possible to more reduce a height in the horizontal type of FIG. 8A and to more reduce a width or a depth (a right to left dimension in FIG. 8B) in the vertical type of FIG. 8B, which will contribute to more reducing the size of the image forming apparatus.

Figure 9A:
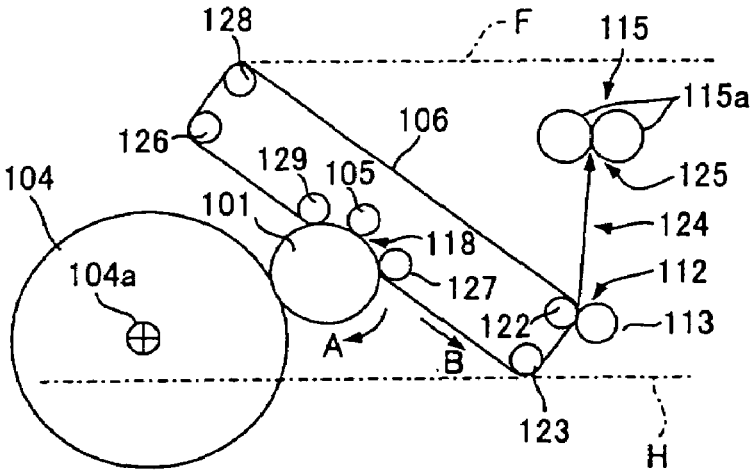
FIGS. 9A and 9B are schematic views showing a layout of leading components in a ninth embodiment of the image forming apparatus of the present invention.
Figure 9B:
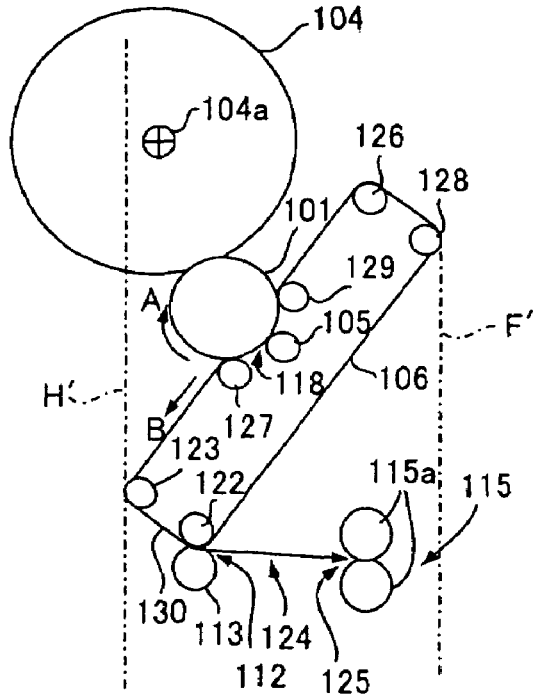

FIGS. 9A and 9B are schematic views showing a layout of leading components in a ninth embodiment of the image forming apparatus of the present invention. A difference between the ninth embodiment and the third embodiment shown in FIGS. 3A and 3B will be explained.

FIGS. 9A and 9B show the center of rotation 104*a* of the rotary developing device 104.

In the ninth embodiment shown in FIGS. 9A and 9B, the photosensitive drum 101 is disposed at a position at which it is in contact with the intermediate transfer belt 106 on the side thereof where the belt 106 moves in a direction in which it approaches the secondary transfer position 112 as well as the photosensitive drum 101 is disposed downstream of a first straight line (a horizontal line H in the horizontal type shown in FIG. 9A, and a vertical line H' in the vertical type shown in FIG. 9B) which is approximately vertical to a direction, in which the partial conveying path 124 extends, of a horizontal line and a vertical line that are in contact with a portion of the intermediate transfer belt 106 on the most upstream side thereof in the sheet conveying direction, similarly to the third embodiment shown in FIGS. 3A and 3B. In addition to the above arrangement, the fixing rolls 115*a* constituting the fixing unit 115 are disposed upstream of a second vertical line (a horizontal line F in the horizontal type shown in FIG. 9A, and a vertical line F' in the vertical type shown in FIG. 9B) which is approximately vertical to a direction, in which the partial conveying path 124 extends, of a horizontal line and a vertical line that are in contact with a portion of the intermediate transfer belt 106 on the most downstream side thereof in the sheet conveying direction.

In addition to the above arrangements, in the ninth embodiment, the center of rotation 104*a* of the rotary developing device 104 is disposed downstream of the first straight line (the horizontal line H in the horizontal type shown in FIG. 9A, and the vertical line H' in the vertical type shown in FIG. 9B) in the sheet conveying direction.

In this case, it is also possible to more reduce a height in the horizontal type of FIG. 9A and to more reduce a width or a depth (a right to left dimension in FIG. 8B) in the vertical type of FIG. 9B, which will contribute to more reducing the size of the image forming apparatus.

Figure 10A:
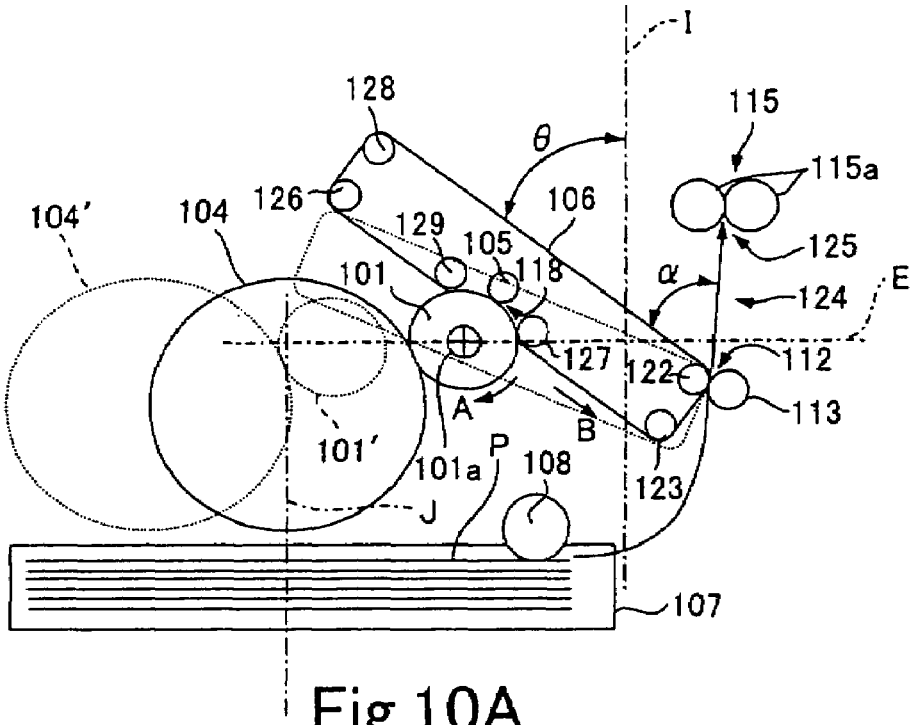
FIGS. 10A and 10B are schematic views showing a layout of leading components in a tenth embodiment of the image forming apparatus of the present invention.
Figure 10B:
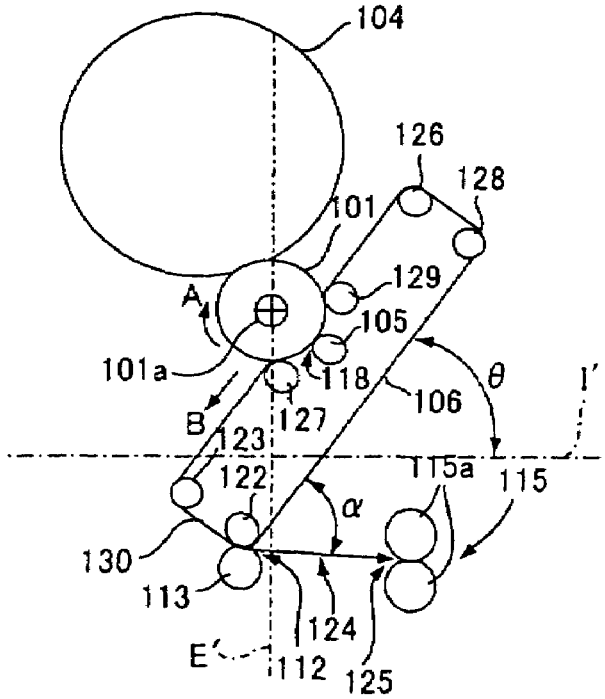

FIGS. 10A and 10B are schematic views showing a layout of leading components in a tenth embodiment of the image forming apparatus of the present invention. A difference between the tenth embodiment and the third embodiment shown in FIGS. 3A and 3B will be explained.

FIG. 10A shows a sheet accommodation unit 107 that accommodates sheets P. The sheets P accommodated in the sheet accommodation unit 107 are fed by a pick-up roll 108, conveyed along a conveying path including the partial conveying path 124 between the secondary transfer position 112 and the fixing position 125, and undergo the transfer of a toner image at the secondary transfer position 112 in the midpoint of the conveyance, and the toner image is fixed on the sheet at the fixing position.

In the tenth embodiment, the intermediate transfer belt 106 is disposed so as to incline at an inclining angle θ of 30° or more to 50° or less with respect to a straight line (a vertical line I in the horizontal type shown in FIG. 10A, and a horizontal line I' in the vertical type shown in FIG. 10B), which extends approximately in parallel with a direction in which the partial conveying path 124 extends, of a horizontal line and a vertical line, the photosensitive drum 101 is disposed on a side of the approximately flat-shaped intermediate transfer belt 106 where the belt 106 moves in a direction in which it approaches the secondary transfer position 112, and the secondary transfer position 112 is disposed upstream of a straight line (a horizontal line E in the horizontal type shown in FIG. 10A, and a vertical line E' in the vertical type shown in FIG. 10B), which is approximately vertical to a direction, in which the partial conveying path 124 extends, of a horizontal line and a vertical line which pass through the center of rotation 101*a* of the photosensitive drum 101, in the sheet conveying direction.

When the above conditions are satisfied, it is also possible to reduce a height in the horizontal type of FIG. 10A and to reduce a width or a depth (a right to left dimension in FIG. 10B) in the vertical type of FIG. 10B similarly to the various types of the embodiments explained up to now, which will contribute to reducing the size of the image forming apparatus.

When the inclining angle θ exceeds 50°, the photosensitive drum 101 and the rotary developing device 104 are separated from the sheet conveying path and disposed at, for example, respective positions 101' and 104' shown by dotted circles shown in FIG. 10A, which makes the reduction in size of the image forming apparatus difficult. In particular, when the developing units of the rotary developing device 104 and the like protrudes externally of the center line J of the sheets P accommodated in the sheet accommodation unit 107 as shown in FIG. 10A, the size of the apparatus is considerably increased as compared with the size of the sheet, and this is not preferable.

In contrast, when the inclining angle θ is less than 30°, since a sheet exfoliating angle α is too small, there is a possibility that the sheet, which has passed through the secondary transfer position 112, cannot be exfoliated well from the intermediate transfer belt 106. When it is intended to increase the sheet exfoliating angle α at the time the inclining angle θ is less than 30°, the fixing rolls 115*a* are disposed in a state that they greatly protrude to the right side of FIG. 10A (down side in FIG. 10B), which makes the reduction in size of the apparatus difficult.

Here, the relationship between the inclining angle θ and the sheet exfoliating angle α will be explained.

In the present invention, the direction, in which the partial conveying path 124 extends between the secondary transfer position 112 and the fixing position 125, is prescribed to, for example, the approximately vertical direction in the horizontal type as shown in FIG. 10A and to the approximately horizontal direction in the vertical type as shown in FIG. 10B. The terms "approximately vertical" and "approximately horizontal" used in the present invention mean that an inclination up to about 30° from a vertical line or a horizontal line is accepted. Further, it is known that the lower limit of the sheet exfoliating angle α is substantially about 70°, and it is preferable that the sheet exfoliating angle α be 90°. Accordingly, when the inclining angle θ of the belt is set to less than 30°, the partial conveying path 124 extends at an angle of 40° or more from the vertical line in the horizontal type shown in FIG. 10A or from the horizontal line in the vertical type shown in FIG. 10B, which deviates from the concept of approximately vertical and approximately horizontal, and the sheet conveying path is greatly diverted, which is contrary to the requirement for the reduction in size of the apparatus.

Further, a distance between the secondary transfer position 112 and the fixing position 125 will be explained.

It is preferable to set the sheet conveying speed at the secondary transfer position 112 slightly faster than that at the fixing position 125 to prevent that an image is elongated by that the sheet is pulled by the fixing unit 115. In this case, since a sheet which is long in a conveying direction, is curved, if the distance between the secondary transfer position 112 and the fixing position 125 is short, there is a possibility that the sheet gets wrinkled or is clogged. Further, if the heat of the fixing unit 115 is transmitted to the intermediate transfer belt 106 and the toners thereon, a problem arises in that the intermediate transfer belt 106 is thermally fatigued or the toners are softened. Under the above circumstances, a certain amount of distance is necessary between the secondary transfer position 112 and the fixing position 125. Specifically, in an image forming apparatus that handles a sheet having a maximum size of A4, the distance must be set to at least 90 mm, and when a sheet having a maximum size of A3 is handled, the distance must be set to at least 150 mm.

Figure 11A:
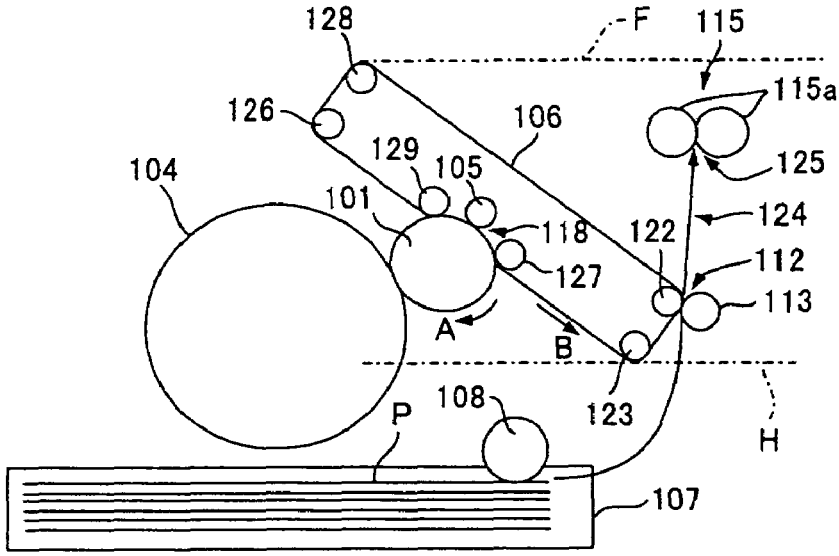
FIGS. 11A and 11B are schematic views showing a layout of leading components in an eleventh embodiment of the image forming apparatus of the present invention.
Figure 11B:
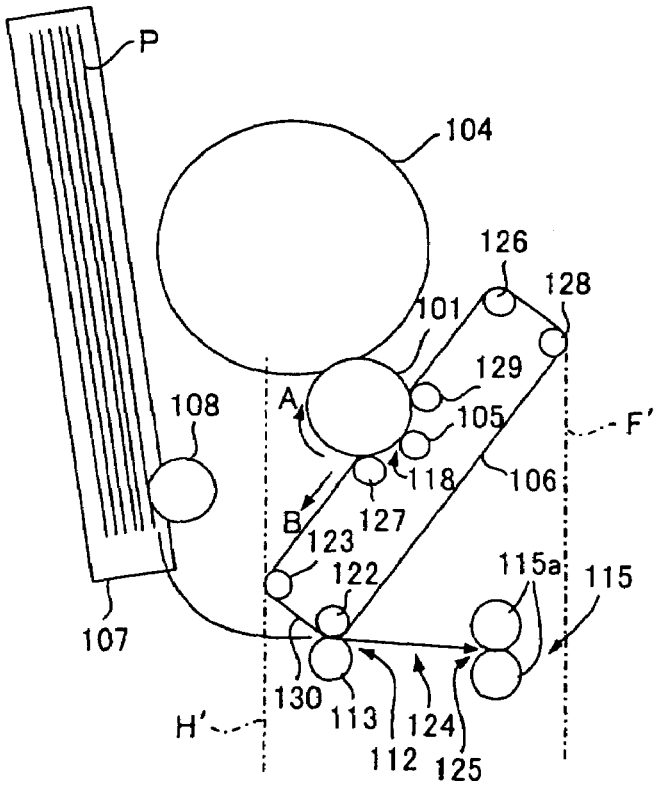

FIGS. 11A and 11B are schematic views showing a layout of leading components in an eleventh embodiment of the image forming apparatus of the present invention. A difference between the eleventh embodiment and the third embodiment shown in FIGS. 3A and 3B will be explained.

FIGS. 11A and 11B show the sheet accommodation unit 107 that accommodates sheets P likewise FIG. 10A. The sheets P accommodated in the sheet accommodation unit 107 are fed by the pick-up roll 108 one by one, conveyed along the predetermined conveying path including the partial conveying path 124 between the secondary transfer position 112 and the fixing position 125, and undergo the transfer of a toner image at the secondary transfer position 112 in the midpoint of the conveyance, and the toner image is fixed on the sheet at the fixing position.

The sheet accommodation unit 107 is disposed in such a direction that the sheets P accommodated therein are approximately vertical to the direction in which the partial conveying path 124 extends. Disposing the sheet accommodation unit 107 in the above direction will contribute to more reducing the size of the image forming apparatus even if this arrangement is combined with any of the above embodiments.

Note that, in this embodiment, the developing device is not limited to the rotary developing device, and any ordinary multi-color developing devices including the rotary developing device may be employed.

Figure 12A:
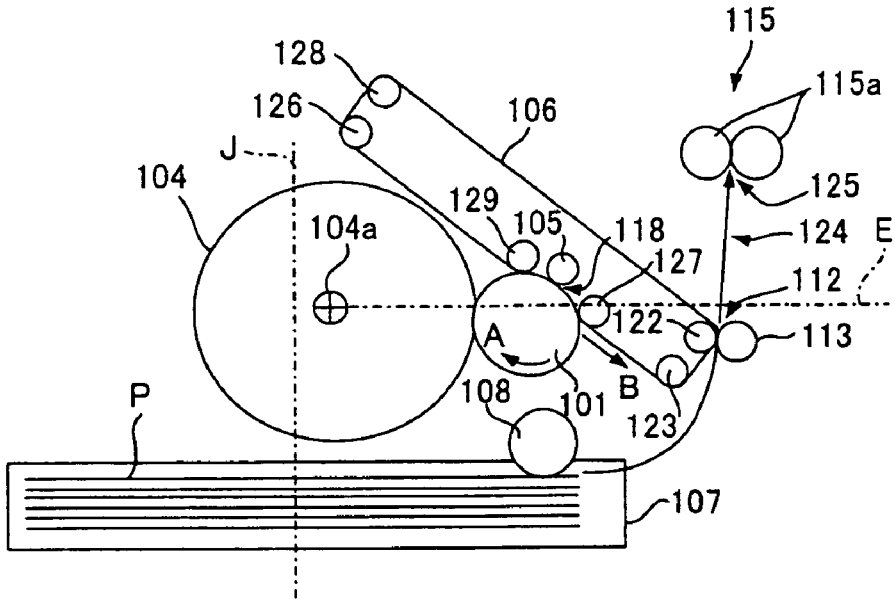
FIGS. 12A and 12B are schematic views showing a layout of leading components in twelfth embodiment of the image forming apparatus of the present invention.
Figure 12B:
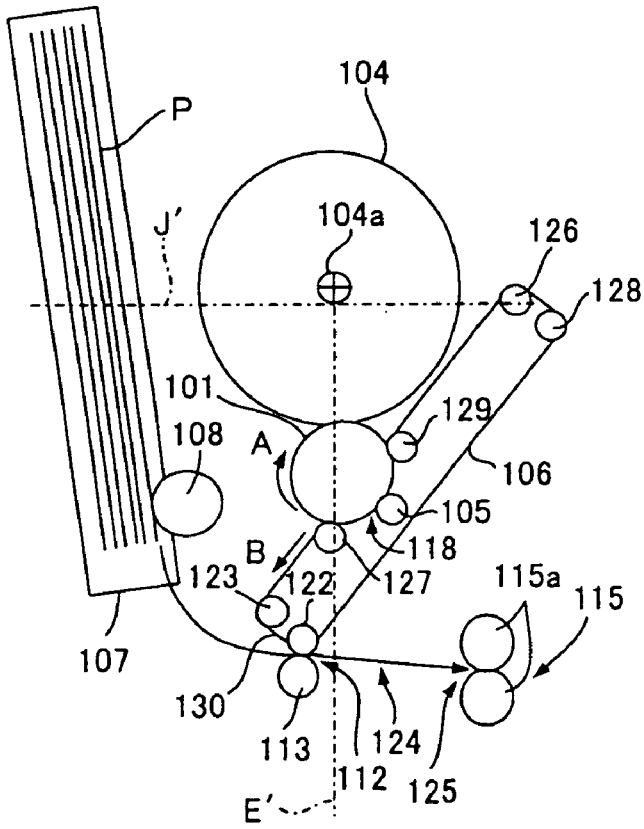

FIGS. 12A and 12B are schematic views showing a layout of leading components in a twelfth embodiment of the image forming apparatus of the present invention.

In the twelfth embodiment shown in FIGS. 12A and 12B, the primary transfer position 118 is disposed on a side where the approximately flat-shaped intermediate transfer belt 106 moves in a direction in which the belt 106 approaches the secondary transfer position 112, the secondary transfer position 112 and the fixing position 125 are disposed upstream and downstream in the sheet conveying direction of a straight line respectively, (a horizontal line E in the horizontal type shown in FIG. 12A, and a vertical line E' in the vertical type shown in FIG. 12B), which is approximately vertical to a direction, in which the partial conveying path 124 extends, of a horizontal line and a vertical line, which pass through the center of rotation. 104*a* of the rotary developing device 104, and further the center of rotation 104*a* of the rotary developing device 104 is disposed in the vicinity of a straight line (a vertical line J in the horizontal type shown in FIG. 12A, and a horizontal line J' in the vertical type shown in FIG. 12B), which extends in a direction parallel with the direction in which the partial conveying path 124 extends, of a horizontal line and a vertical line that pass through the sheet P accommodated in the sheet accommodation unit 107 at a point thereof disposed one half the length of the sheet P in a direction in which it is fed from the sheet accommodation unit 107.

When the above conditions are satisfied, it is also possible to reduce a height in the horizontal type of FIG. 12A and to reduce a width or a depth (a right to left dimension in FIG. 12B) in the vertical type of FIG. 12B similarly to the various types of the embodiments explained up to now, which will contribute to reducing the size of the image forming apparatus.

Figure 13A:
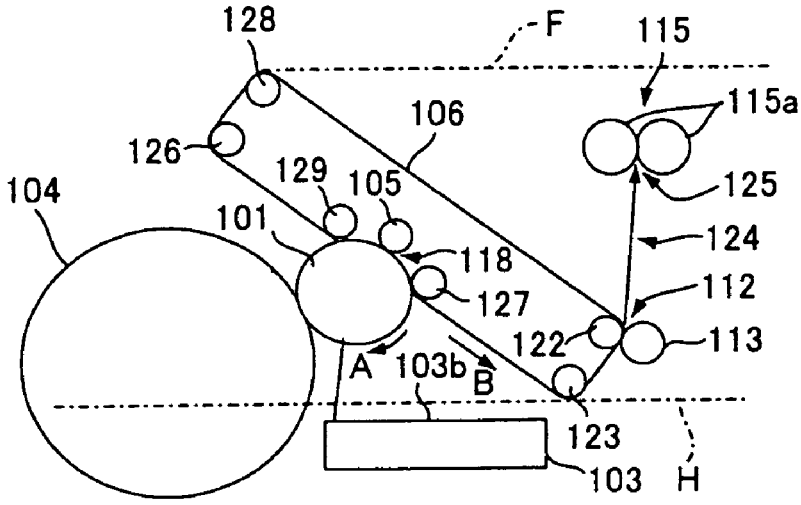
FIGS. 13A and 13B are schematic views showing a layout of leading components in a thirteenth embodiment of the image forming apparatus of the present invention.
Figure 13B:
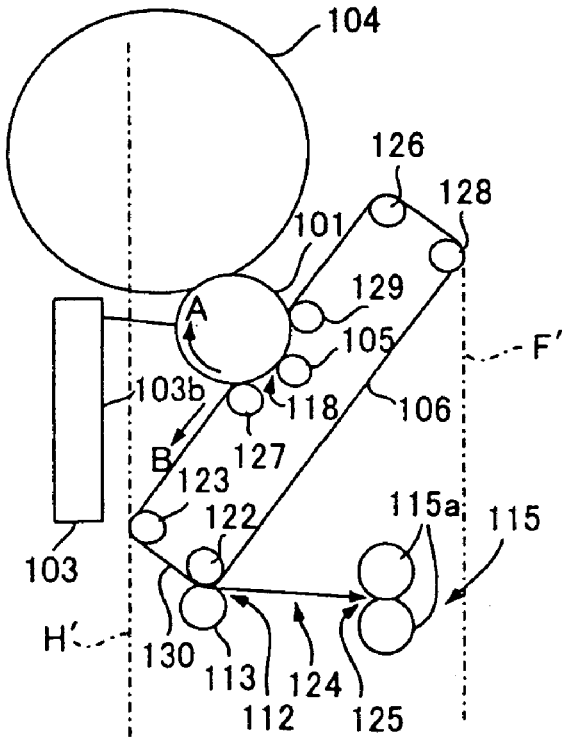

FIGS. 13A and 13B are schematic views showing a layout of leading components in a thirteenth embodiment of the image forming apparatus of the present invention.

FIGS. 13A and 13B show the exposure unit 103 that is formed in a flat shape in its entirety and forms an electrostatic latent image on the photosensitive drum 101 by exposing the drum 101. The exposure unit 103 is disposed in such a direction that the direction, in which the partial conveying path 124 extends, is approximately vertical to the surface 103*b* of the exposure unit 103 which expands flatly.

Disposing the exposure unit 103 in the above direction will contribute to more reducing the size of the image forming apparatus even if this arrangement is combined with any of the above embodiments.

Note that, in this embodiment, the developing device is not limited to the rotary developing device, and any ordinary multi-color developing devices including the rotary developing device may be employed.

Figure 14:
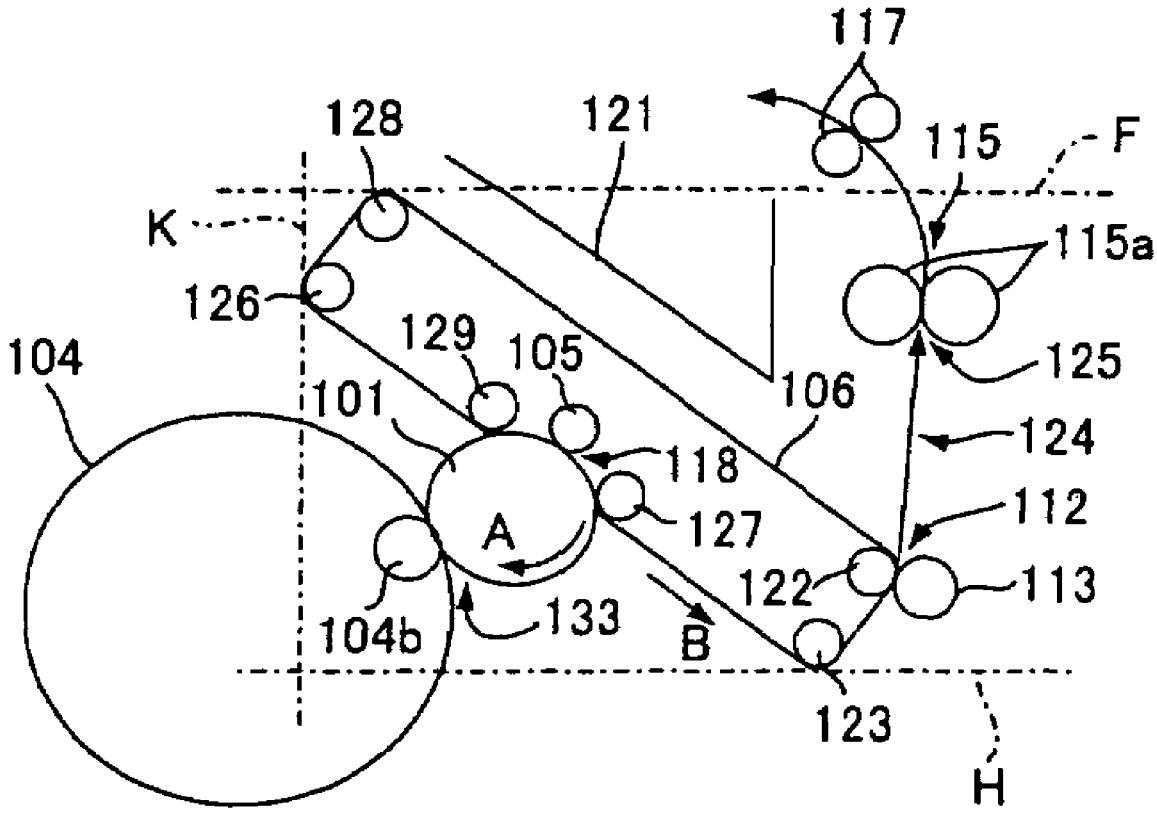
FIG. 14 is view showing a layout of leading components in a fourteenth embodiment of the image forming apparatus of the present invention.

FIG. 14 is a schematic view showing a layout of leading components in a fourteenth embodiment of the image forming apparatus of the present invention.

The components that execute the same operations as those of the components shown in the respective figures explained up to now are also denoted by the same reference numerals for easy understanding.

In the embodiment shown in FIG. 14, the intermediate transfer belt 106 is disposed so as to incline downstream in the sheet conveying direction, that is, the belt 106 is disposed so as to incline to a direction in which the partial conveying path 124 extends, the photosensitive drum 101 is disposed in contact with a side of the approximately flat-shaped intermediate transfer belt 106 where the belt 106 moves in a direction in which it approaches the second support roll 123. In addition, the overall photosensitive drum 101 is disposed downstream of a first horizontal line (a horizontal line H) with which the intermediate transfer belt 106 comes into contact at the most upstream side portion thereof in the sheet conveying direction as well as disposed nearer to the partial conveying path 124 than a vertical line (a vertical line K) with which the intermediate transfer belt 106 comes into contact at the portion thereof farthest from the partial conveying path 124.

That is, in the embodiment shown in FIG. 14, both the photosensitive drum 101 and the developing roll 104*b* are disposed within a triangle region formed by the approximately flat-shaped intermediate transfer belt 106, the vertical line (the vertical line K) that is in contact with the intermediate transfer belt 106, and the horizontal line (the horizontal line H) that is in contact with the intermediate transfer belt 106.

Further, the sheet discharge rolls 117 are disposed downstream of a second horizontal line (a horizontal line F) that is in contact with the intermediate transfer belt 106 in the most downstream side portion thereof in the sheet conveying direction as well as at least a part of the sheet discharge tray 121 is disposed upstream of the second horizontal line (the horizontal line F) in the sheet conveying direction.

In the fourteenth embodiment, since the portion between the first and second support rolls 122 and 123 are supported flatly, it is not necessary to greatly curve the sheet conveying path, and thus a space larger than necessary is not required in the portion below the secondary transfer position 112, which will contribute to reducing the size of the image forming means as a first point. Further, the sheet discharge rolls 117 are disposed downstream of the horizontal line F in the sheet conveying direction as well as at least a part of the sheet discharge tray 121 is disposed upstream of the horizontal line F in the sheet conveying direction. Accordingly, even if the height of the image forming apparatus, in which the most downstream portion of the intermediate transfer belt 106 in the sheet conveying direction is accommodated, is more increased by a cover and the like of the image forming apparatus, the height of the overall image forming apparatus can be suppressed as mush as possible as well as the sheet discharge tray 121, in which discharge sheets are accommodated, can be disposed at a position as low as possible. As a result, the components above the secondary transfer position 112 can be disposed in a space that is as small as possible, which will contribute to reducing the size of the image forming apparatus as a second point.

As described above, the height of the image forming apparatus can be reduced also in the fourteenth embodiment shown in FIG. 14 likewise the horizontal type in the respective embodiments explained up to now, which will contribute to reducing the size of the image forming apparatus.

Further, FIG. 14 shows the developing roll 104*b*, which is disposed at a position facing the photosensitive drum 101, of the developing device that constitutes the rotary developing device 104.

In the embodiment shown in FIG. 14, the developing position 133, at which the developing roll 104*b* faces the photosensitive drum 101, that is, the developing position, at which an electrostatic latent image on the photosensitive drum 101 is developed by the rotary developing device 104, is disposed downstream of the first horizontal line H in the sheet conveying direction as well as on a side nearer to the partial conveying path 124 than the vertical line K.

As described above, disposing the developing position 133 at the above position will contribute to more reducing the size of the image forming apparatus.

Further, the fixing unit 115 is shown in the embodiment illustrated in FIG. 14. The fixing unit 115 has the pair of fixing rolls 115*a* that rotate while clamping therebetween a sheet which has undergone the transfer of a toner image, and fix the toner image on the sheet.

The above arrangement will contribute to more reducing the size of the image forming apparatus.

Figure 15:
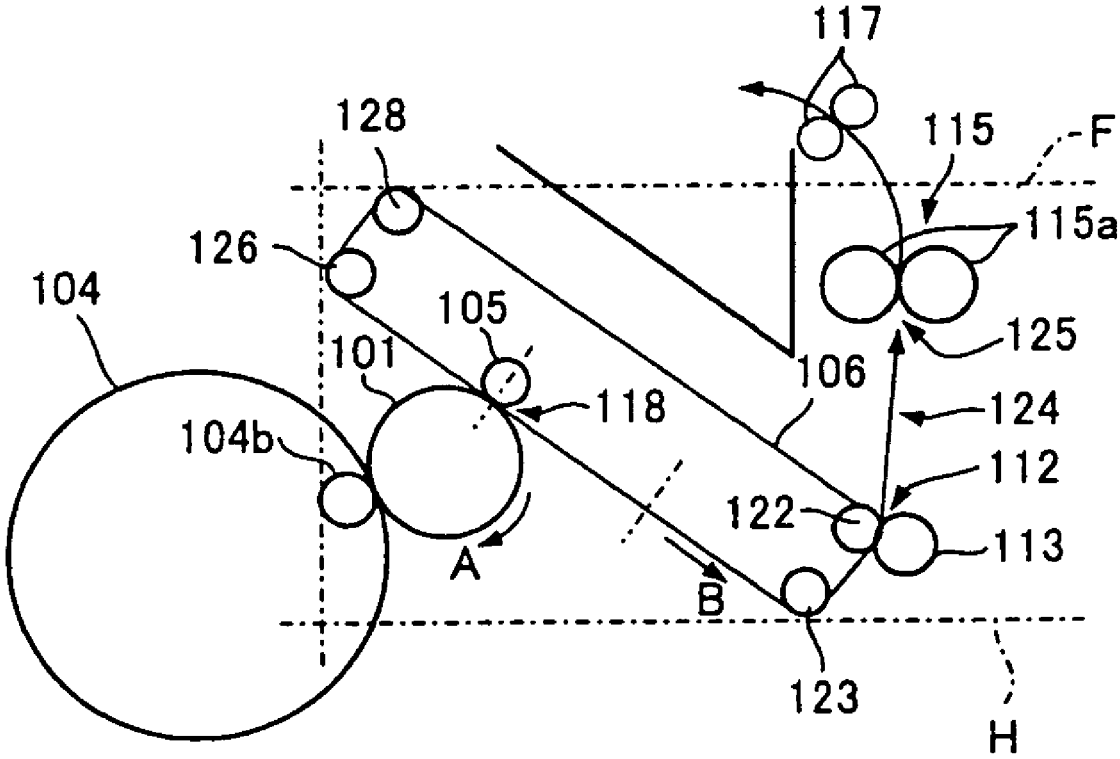
FIG. 15 is a view showing a layout of leading components in a fifteenth embodiment of the image forming apparatus of the present invention.

FIG. 15 is a schematic view showing a layout of leading components in a fifteenth embodiment of the image forming apparatus of the present invention.

The components that execute the same operations as those of the components shown in the respective figures explained up to now are also denoted by the same reference numerals for easy understanding.

In the embodiment shown in FIG. 15, the intermediate transfer belt 106 is disposed so as to incline downstream in the sheet conveying direction, the photosensitive drum 101 is disposed in contact with a side of the approximately flat-shaped intermediate transfer belt 106 where the belt 106 moves in a direction in which it approaches the second support roll 123. In addition, the overall photosensitive drum 101 is disposed downstream of a first horizontal line (a horizontal line H) with which the intermediate transfer belt 106 comes into contact at the most upstream side portion thereof in the sheet conveying direction as well as disposed nearer to the partial conveying path 124 than a vertical line (a vertical line K) with which the intermediate transfer belt 106 comes into contact at the portion thereof farthest from the partial conveying path 124, similarly to the embodiment shown in FIG. 14.

Further, the sheet discharge rolls 117 are disposed downstream of a second horizontal line (a horizontal line F) that is in contact with the intermediate transfer belt 106 in the most downstream side portion thereof in the sheet conveying direction as well as at least a part of the sheet discharge tray 121 is disposed upstream of the second horizontal line (a horizontal line F) in the sheet conveying direction.

Accordingly, the embodiment shown in FIG. 15 can also reduce the height of the image forming apparatus similarly to the embodiment shown in FIG. 14, which will contribute to reducing the size of the image forming apparatus.

In the embodiment shown in FIG. 15, the above conditions are achieved by disposing the primary transfer position 118 in a range of about two third a long side portion of the intermediate transfer belt 106 where it moves in a direction in which it approaches the second support roll 123 upstream of the long side portion in the moving direction of the belt 106.

Figure 16:
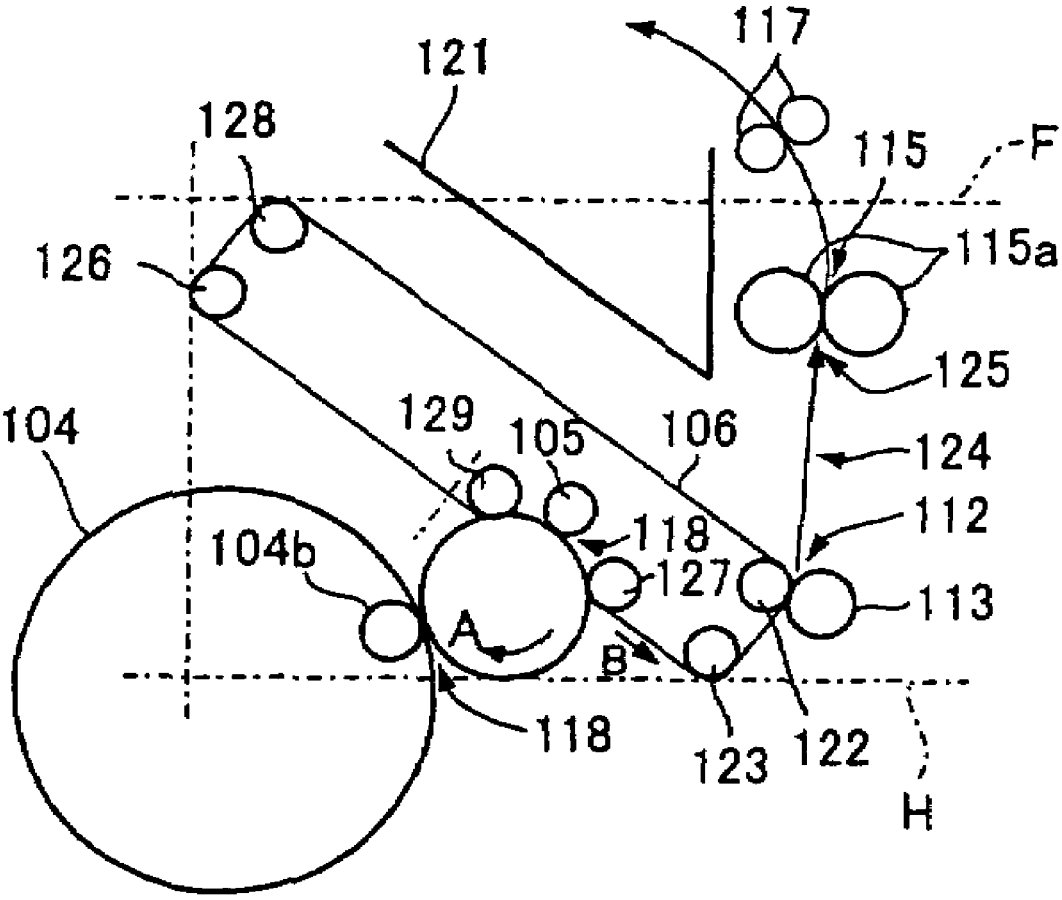
FIG. 16 is a view showing a layout of leading components in a sixteenth embodiment of the image forming apparatus of the present invention.

FIG. 16 is a schematic view showing a layout of leading components in a sixteenth embodiment of the image forming apparatus of the present invention.

The components that execute the same operations as those of the components shown in the respective figures explained up to now are also denoted by the same reference numerals for easy understanding.

In the embodiment shown in FIG. 16, the intermediate transfer belt 106 is disposed so as to incline downstream in the sheet conveying direction, the photosensitive drum 101 is disposed in contact with a side of the approximately flat-shaped intermediate transfer belt 106 where the belt 106 moves in a direction in which it approaches the second support roll 123. In addition, the overall photosensitive drum 101 is disposed downstream of a first horizontal line H with which the intermediate transfer belt 106 comes into contact at the most upstream side portion thereof as well as disposed nearer to the partial conveying path 124 than a vertical line K with which the intermediate transfer belt 106 comes into contact at the portion thereof farthest from the partial conveying path 124, similarly to the embodiments shown in FIGS. 14 and 15.

Further, the sheet discharge rolls 117 are disposed downstream of a second horizontal line (a horizontal line F) that is in contact with the intermediate transfer belt 106 in the most downstream side portion thereof in the sheet conveying direction as well as at least a part of the sheet discharge tray 121 is disposed upstream of the second horizontal line (the horizontal line F) in the sheet conveying direction.

Accordingly, the embodiment shown in FIG. 16 can also reduce the height of the image forming apparatus similarly to the embodiments shown in FIGS. 14 and 15, which will contribute to reducing the size of the image forming apparatus.

In the embodiment shown in FIG. 16, the above conditions are achieved by disposing the photosensitive drum 101 approximately at the center of a long side portion of the intermediate transfer belt 106 where it moves in a direction in which it approaches the second support roll 123 in a state that the photosensitive drum 101 is in contact with the intermediate transfer belt 106 in a predetermined region in the moving direction thereof, that is, by disposing the photosensitive drum 101 so as to be engaged in the intermediate transfer belt 106.

Figure 17:
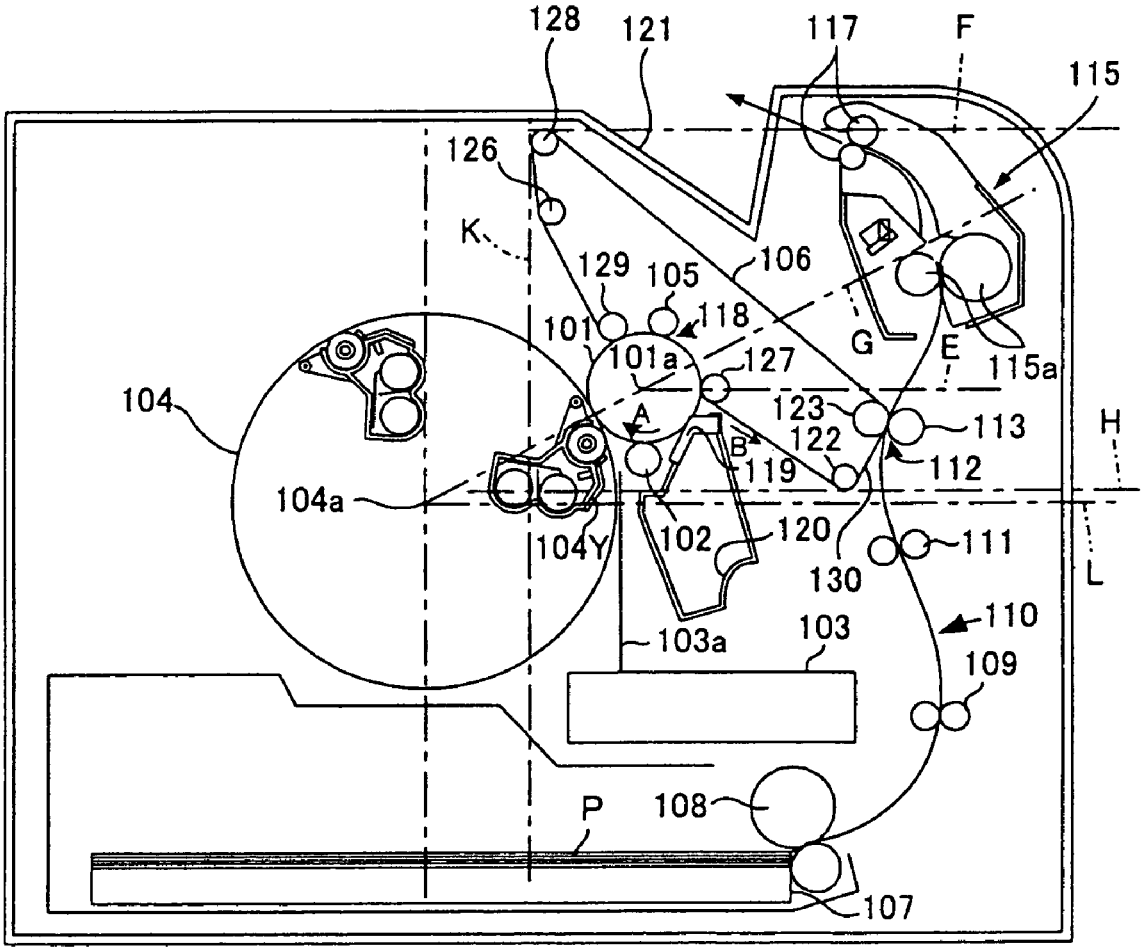
FIG. 17 is a view showing an arrangement of a seventeenth embodiment of the image forming apparatus of the present invention.

FIG. 17 is a view showing an arrangement of a seventeenth embodiment of the image forming apparatus of the present invention.

In the seventeenth embodiment, the components that execute the same operations as those of the components shown in the respective figures explained up to now are also denoted by the same reference numerals even if they are formed in different shapes and disposed differently for easy understanding.

The photosensitive drum 101 is charged by the charging unit 102 while rotating in the direction of an arrow A about the centre of rotation 101*a* thereof, an electrostatic latent image is formed on the photosensitive drum 101 by the exposure light 103*a* from the exposure unit 103, and the electrostatic latent image is developed by the rotary developing device 104.

The rotary developing device 104 has multiple developing units, for examle a developing unit 104Y, which are disposed around the center of rotation 104*a* thereof, and in which the respective color toners are accommodated, and when the rotary developing device 104 is rotated, the electrostatic latent image formed on the photosensitive drum 101 is developed by a developing unit (the developing unit 104Y in a state shown in FIG. 17) that faces the photosensitive drum 101.

A toner image is formed on the photosensitive drum 101 by being developed by the rotary developing device 104 and transferred onto the intermediate transfer belt 106, which is circulatingly moved in the direction of an arrow B, by the action of the transfer unit 105 at the primary transfer position 118. After the toner image has been transferred, the surface thereof is cleaned by the cleaner 119, and a toner image forming operation is executed again by starting the operation from the charge of the photosensitive drum 101 executed by the charging unit 102. Waste toners, which have been removed from the photosensitive drum 101 by the cleaning executed by the cleaner 119, are accommodated in a waste toner tank 120.

When a color image is formed, the above image forming cycle is repeated four times, thereby a toner image composed of toners of four colors of cyan (C), magenta (M), yellow (Y), and black (K) is formed on the intermediate transfer belt 106.

In contrast, a sheet P is fed from the sheet accommodation unit 107 by the pick-up roll 108, conveyed by conveying rolls 109 along a conveying path 110, sent to the secondary transfer position 112 by registration rolls 111 in exact timing with the toner image formed on the intermediate transfer belt 106 and composed of the four colors of CMYK. At the secondary transfer position 112, the four-color toner image on the intermediate transfer belt 106 is secondarily transferred onto the sheet by the action of the transfer unit 113.

The sheet, which has undergone the transfer of the four-color toner image, is further conveyed while carrying the four-color toner image, clamped between the pair of fixing rolls 115*a* disposed on the fixing unit 115, and heated and pressurized thereby, and thus the toner image is fixed on the sheet.

The sheet, on which the color image has been formed by fixing the toner image thereon, is further conveyed and discharged onto the discharge sheet tray 121 disposed externally of the cabinet of the image forming apparatus by the sheet discharge rolls 117.

The modes of the various types of the embodiments described above are complexly realized in the image forming apparatus of the embodiment shown in FIG. 17. Specifically, the respective embodiments of the first image forming apparatus (refer to FIG. 1), the second image forming apparatus (refer to FIGS. 2A and 2B), the third image forming apparatus (refer to FIGS. 3, 5, 6, and 7), and the fourth image forming apparatus (refer to FIG. 10) of the present invention are realized, and further the modes explained with reference to FIGS. 11 and 13 are realized.

Figure 18:
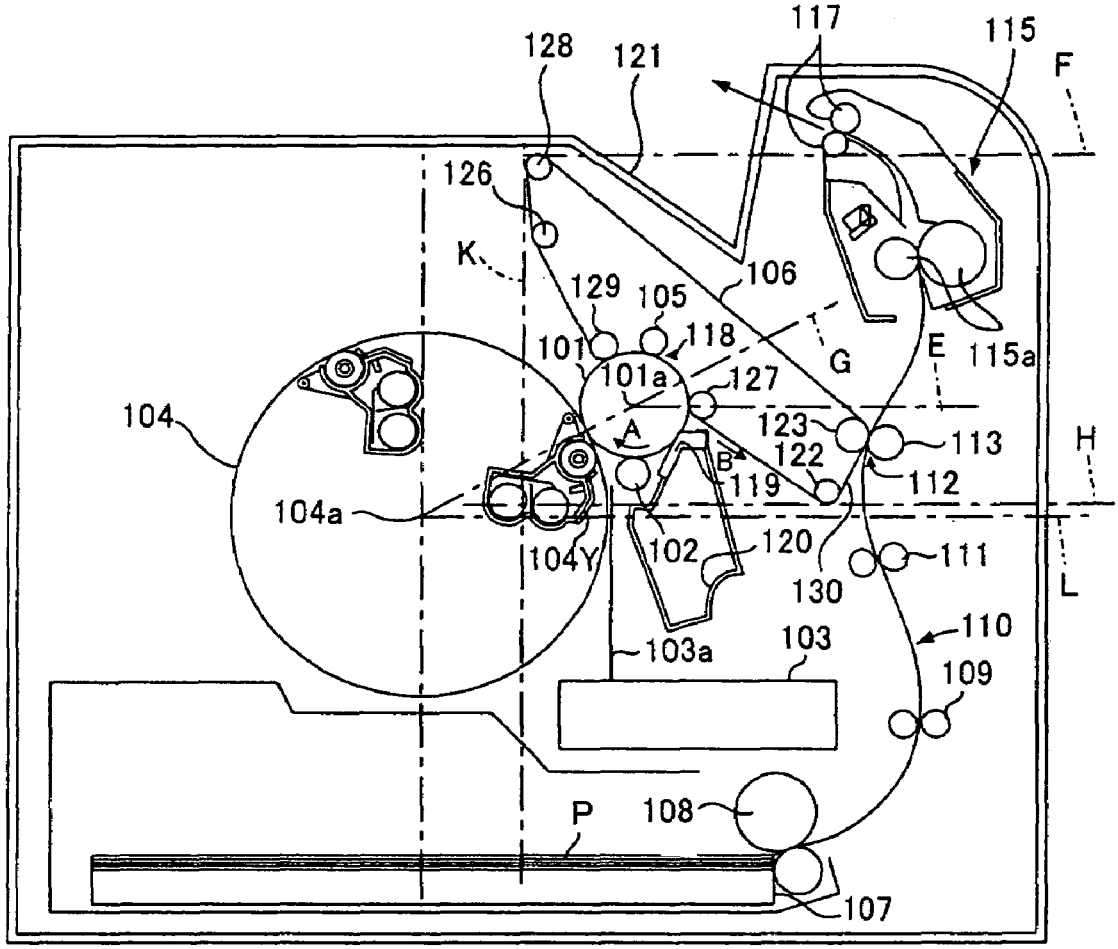
FIG. 18 is a view showing an arrangement of an eighteenth embodiment of the image forming apparatus of the present invention.

FIG. 18 is a view showing an arrangement of an eighteenth embodiment of the image forming apparatus of the present invention.

In the eighteenth embodiment, the components that execute the same operations as those of the components shown in the respective figures explained up to now are also denoted by the same reference numerals even if they are formed in different shapes and disposed differently for easy understanding. In particular, a difference between the eighteenth embodiment and the seventeenth embodiment shown in FIG. 17 will be explained with reference to FIG. 18.

The image forming apparatus shown in FIG. 18 is different from that shown in FIG. 17 in that the sheet discharge rolls 117 are disposed downstream of a horizontal line F in the sheet conveying direction.

Disposing the sheet discharge rolls 117 at this position can securely prevent a disadvantage that a sheet which has been discharged onto the sheet discharge tray 121 is caught and pushed by the extreme end of a sheet which is subsequently discharged, and dropped from the sheet discharge tray 121.

The modes of the respective embodiments described above are also complexly realized in the image forming apparatus of the embodiment shown in FIG. 18 similarly to the seventeenth embodiment shown in FIG. 17. Specifically, the respective embodiments of the second image forming apparatus (refer to FIGS. 2A and 2B), the third image forming apparatus (refer to FIGS. 3, 5, 6, and 7), the fourth image forming apparatus (refer to FIG. 10), and the sixth image forming apparatus (refer to FIGS. 14, 15, 16) of the present invention are realized, and further the modes explained with reference to FIGS. 11 and 13 are realized.

Figure 19:
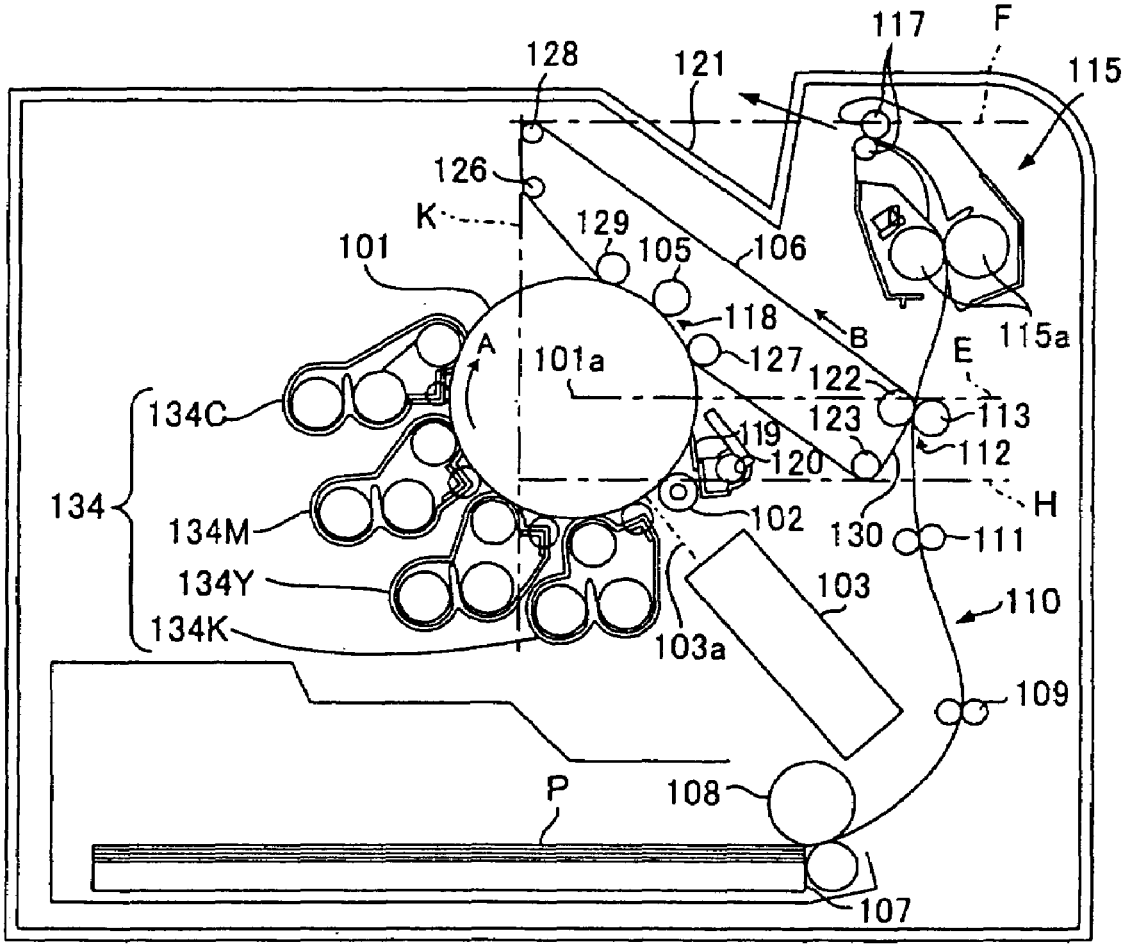
FIG. 19 is a view showing an arrangement of a nineteenth embodiment of the image forming apparatus of the present invention.

FIG. 19 is a view showing an arrangement of a nineteenth embodiment of the image forming apparatus of the present invention.

In the nineteenth embodiment, the components that execute the same operations as those of the components shown in the respective figures explained up to now are also denoted by the same reference numerals even if they are formed in different shapes and disposed differently for easy understanding.

The photosensitive drum 101 is charged by the charging unit 102 while rotating in the direction of an arrow A about the center of rotation 101*a* thereof, an electrostatic latent image is formed on the photosensitive drum 101 by the exposure light 103*a* from the exposure unit 103, and the electrostatic latent image is developed by a multi-color developing device 134.

Although the rotary developing device 104 shown in FIG. 17 is also a kind of the multi-color developing device, the multi-color developing device 134 shown in FIG. 18 is not the rotary developing device and is composed of four developing units 134C, 134M, 134Y, and 134K each having a function for independently developing the electrostatic latent image formed on one set of the photosensitive drum 101.

A toner image is formed on the photosensitive drum 101 by the development executed by any one of the four developing units 134C, 134M, 134Y, and 134K that constitute the multi-color developing device 134 and transferred onto the intermediate transfer belt 106 that circulatingly moves in the direction of an arrow B by the action of the transfer unit 105 at the primary transfer position 118. After the toner image has been transferred onto the photosensitive drum 101, the surface thereof is cleaned by the cleaner 119, and a toner image forming operation is executed again by starting the operation from the charge of the photosensitive drum 101 executed by the charging unit 102. Waste toners, which have been removed from the photosensitive drum 101 by the cleaning executed by the cleaner 119, are accommodated in the waste toner tank 120.

When a color image is formed, the above image forming cycle is repeated four times while development is executed once in each cycle by each of the developing units 134C, 134M, 134Y, and 134K,. thereby a toner image composed of toners of four colors cyan (C), magenta (M), yellow (Y), and black (K)., is formed on the intermediate transfer belt 106.

In contrast, a sheet P is fed from the sheet accommodation unit 107 by the pick-up roll 108, conveyed by conveying rolls 109 along the conveying path 110, sent to the secondary transfer position 112 by the registration rolls 111 in exact timing with the toner image formed on the intermediate transfer belt 106 and composed of the four CMYK colors. At the secondary transfer position 112, the four-color toner image on the intermediate transfer belt 106 is secondarily transferred onto the sheet by the action of the transfer unit 113.

The sheet, which has undergone the transfer of the four-color toner image, is further conveyed while carrying the four-color toner image, clamped between the pair of fixing rolls 115*a* disposed on the fixing unit 115, and heated and pressurized thereby, and the toner image is fixed on the sheet.

The sheet, on which the color image is formed by fixing the toner image thereon, is further conveyed and discharged onto the discharge sheet tray 121 disposed externally of the cabinet of the image forming apparatus by the sheet discharge rolls 117.

The modes of the respective embodiments described above are also complexly realized in the image forming apparatus of the nineteenth embodiment shown in FIG. 19 similarly to the seventeenth and eighteenth embodiments shown in FIGS. 17 and 18, respectively. Specifically, the respective embodiments of the second image forming apparatus (refer to FIGS. 2A and 2B), the third image forming apparatus (refer to FIGS. 3 and 5), and the fourth image forming apparatus (refer to FIG. 10) of the present invention are realized, and further the mode explained with reference to FIG. 11 is realized.

Figure 20:
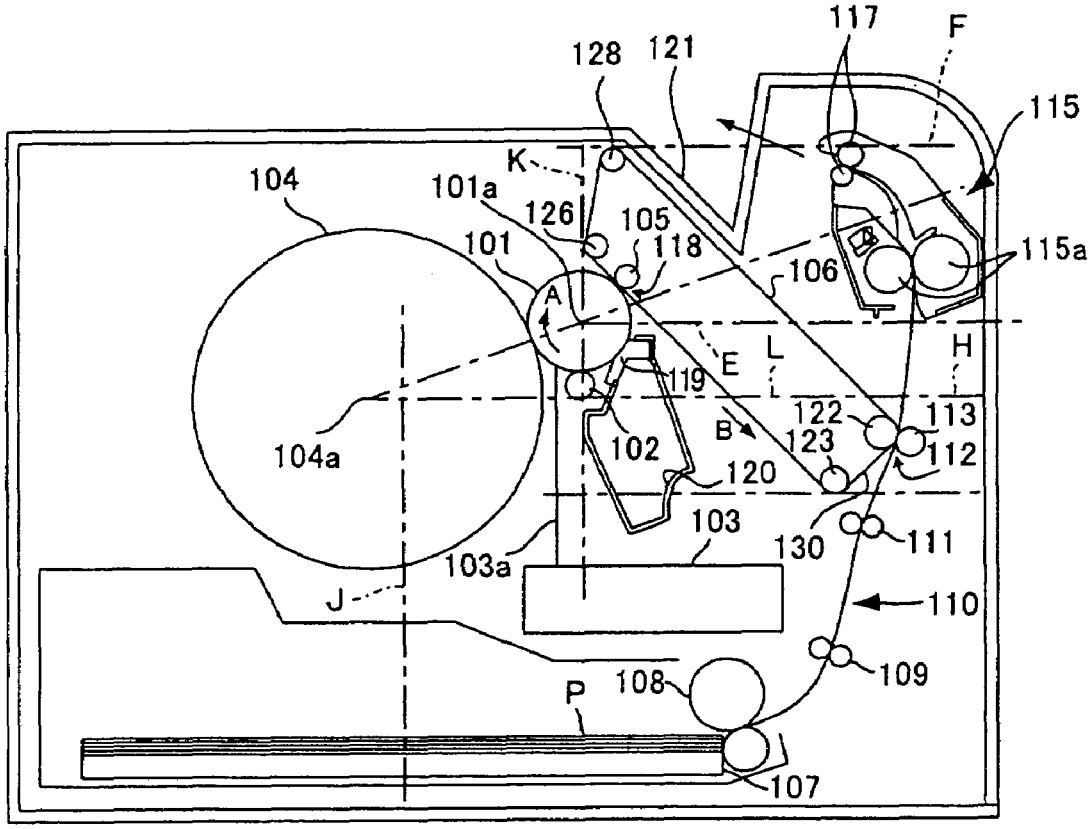
FIG. 20 is a view showing an arrangement of a twentieth embodiment of the image forming apparatus of the present invention.
Figure 21:
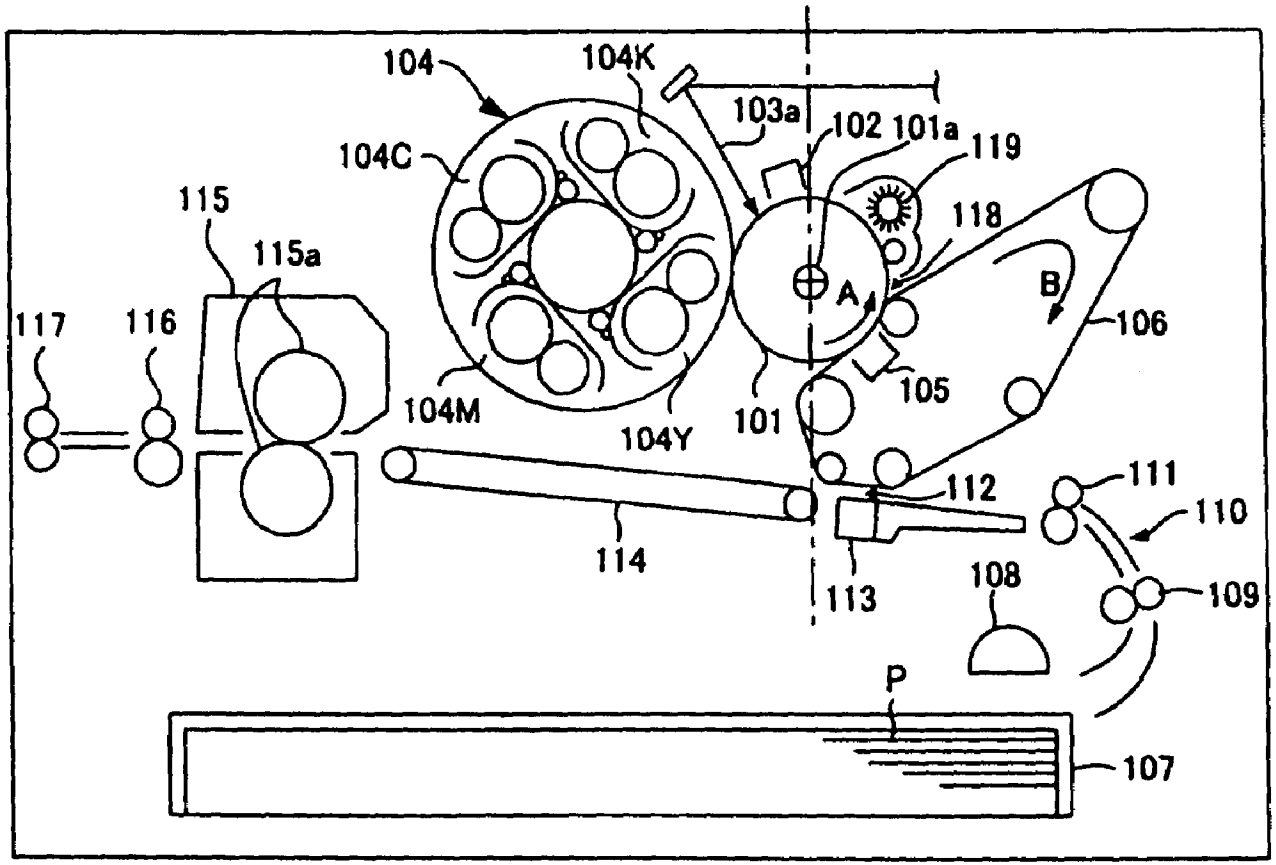
Fig. 21 PRIOR ART
FIG. 21 is a view showing an arrangement of an example of a known image forming apparatus.
Figure 22:
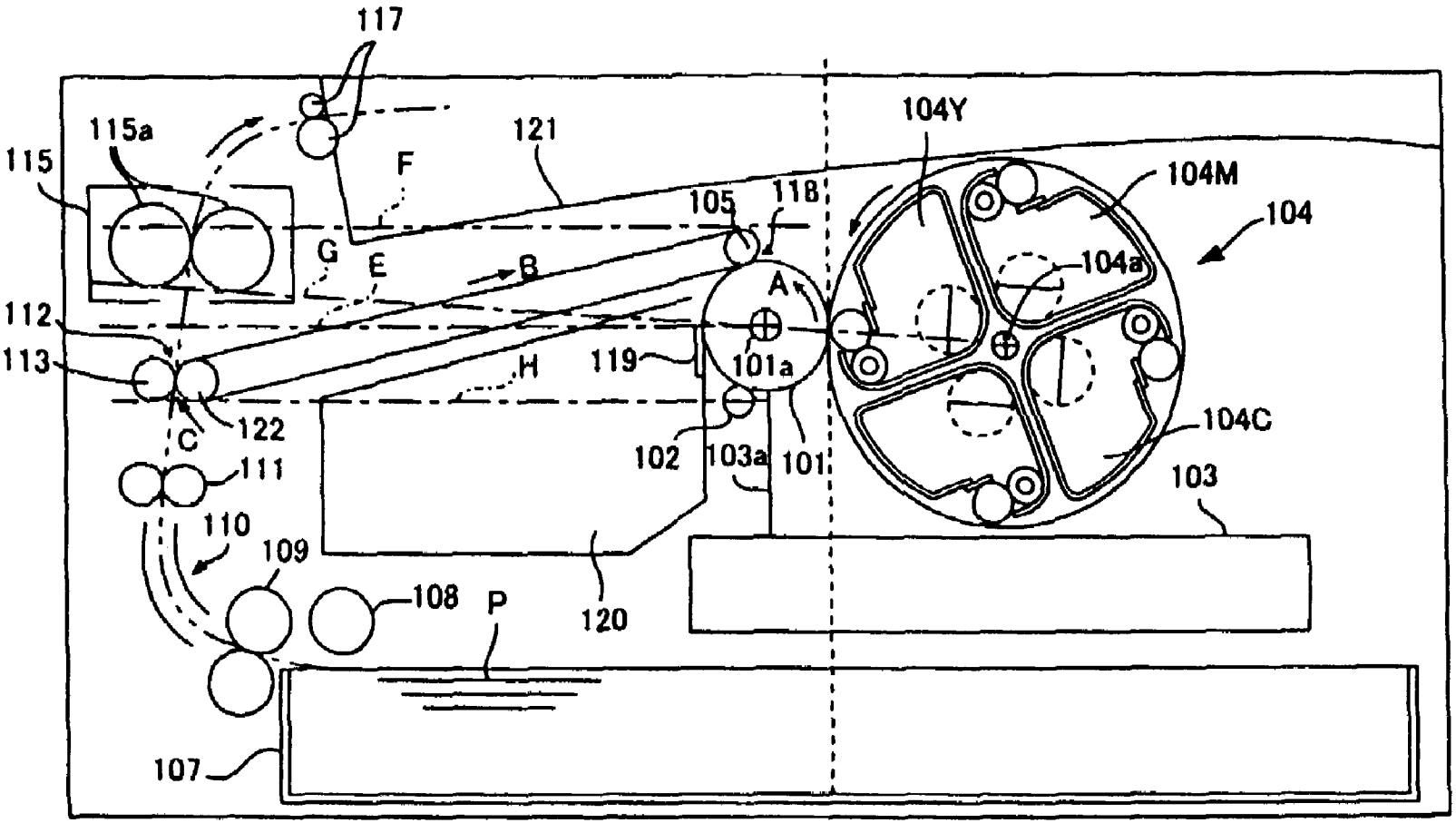
Fig. 22 PRIOR ART
FIG. 22 is a view showing an arrangement of another example of the known image forming apparatus.

FIG. 20 is a view showing an arrangement of a twentieth embodiment of the image forming apparatus of the present invention.

In the twentieth embodiment, the components that execute the same operations as those of the components shown in the respective figures explained up to now are denoted by the same reference numerals even if they are formed in different shapes and disposed differently for easy understanding.

The photosensitive drum 101 is charged by the charging unit 102 while rotating in the direction of an arrow A about the centre of rotation 101*a* thereof, an electrostatic latent image is formed on the photosensitive drum 101 by the exposure light 103*a* from the exposure unit 103, and the electrostatic latent image is developed by the rotary developing device 104.

A toner image, which is formed on the photosensitive drum 101 by the development executed by the rotary developing device 104 is transferred onto the intermediate transfer belt 106, which circulates in the direction of an arrow B by the action of the transfer unit 105 at the primary transfer position 118. After the toner image has been transferred onto the photosensitive drum 101, the surface thereof is cleaned by the cleaner 119, and a toner image forming operation is executed again by starting the operation from the charge of the photosensitive drum 101 executed by the charging unit 102. Waste toners, which have been removed from the photosensitive drum 101 by the cleaning executed by the cleaner 119, are accommodated in the waste toner tank 120.

When a color image is formed, the above image forming cycle is repeated four times, thereby a toner image composed of toners of four colors of cyan (C), magenta (M), yellow (Y), and black (K) is formed on the intermediate transfer belt 106.

In contrast, a sheet P is fed from the sheet accommodation unit 107 by the pick-up roll 108, conveyed by the conveying rolls 109 along the conveying path 110, sent to the secondary transfer position 112 by the registration rolls 111 in exact timing with the toner image formed on the intermediate transfer belt 106 and composed of the four CMYK colors. At the secondary transfer position 112, the four-color toner image on the intermediate transfer belt 106 is secondarily transferred onto the sheet by the action of the transfer unit 113.

The sheet, which has undergone the transfer of the four-color toner image, is further conveyed while carrying the four-color toner image, clamped between the pair of fixing rolls 115*a* disposed on the fixing unit 115, and heated and pressurized thereby, and the toner image is fixed on the sheet.

The sheet, onto which the color image is formed by fixing the toner image thereon, is further conveyed and discharged onto the discharge sheet tray 121 disposed externally of the cabinet of the image forming apparatus by the sheet discharge rolls 117.

The modes of the respective embodiments described above are also complexly realized in the image forming apparatus of the twentieth embodiment shown in FIG. 20 similarly to the image forming apparatuses of the seventeenth to nineteenth embodiments shown in FIGS. 17 to 19. Specifically, the respective embodiments of the first image forming apparatus (refer to FIG. 1), the third image forming apparatus (refer to FIGS. 3, 5, 6, 7, and 9), and the fifth image forming apparatus (refer to FIG. 12) of the present invention are realized, and further the modes explained with reference to FIGS. 11 and 13 are realized.

What is claimed is:

1. An image forming apparatus comprising:

an image carrier which has a predetermined center of rotation and on which a toner image is formed by developing an electrostatic latent image formed thereon with a toner;

a rotary developing device that has a plurality of developing units, which are disposed about a predetermined center of rotation thereof, and in which respective color toners are accommodated, and develops the electrostatic latent image on the image carrier by a developing unit which is faced to the image carrier by the rotation of the rotary developing device;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material;

a fixing unit which fixes the toner image on the transfer material, which has undergone the transfer of the toner image, thereon at a predetermined fixing position; and a conveying path along which the transfer material passes through the secondary transfer position and the fixing position and which has a partial conveying path extending approximately vertically between the secondary transfer position and the fixing position, wherein the primary transfer position is disposed on a side where the approximately flat-shaped intermediate transfer member moves in a direction in which the intermediate transfer member approaches the secondary transfer position, wherein the secondary transfer position is disposed upstream, with respect to the transfer material conveying direction, of a horizontal line that pass through the center of rotation of the image carrier, and wherein the fixing position is disposed upstream, with respect to the transfer material conveying direction, of a straight line which passes through the center of rotation of the rotary developing device and the center of rotation of the image carrier.

2. An image forming apparatus comprising:

an image carrier which has a predetermined center of rotation and on which a toner image is formed by developing an electrostatic latent image formed thereon with a toner;

a multi-color developing device which has a plurality of developing units disposed thereon and accommodating respective color toners and develops the electrostatic latent image on the image carrier by a developing unit selected from the plurality of developing units;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material;

a fixing unit which fixes the toner image on the transfer material, which has undergone the transfer of the toner image, thereon at a predetermined fixing position; and a conveying path along which the transfer material passes through the secondary transfer position and the fixing position and which has a partial conveying path extending approximately vertically between the secondary transfer position and the fixing position, wherein the primary transfer position is disposed in an intermediate portion on a side where the flat-shaped intermediate transfer member moves in a direction in which the intermediate transfer member approaches the secondary transfer position, wherein the secondary transfer position is disposed upstream, with respect to the transfer material conveying direction, of a horizontal line that pass through the center of rotation of the image carrier, and wherein the fixing position is disposed upstream, with respect to the transfer material conveying direction, of a line that passes through the center of rotation of the rotary developing device and the center of rotation of the image carrier.

3. An image forming apparatus comprising:

an image carrier which has a predetermined center of rotation and on which a toner image is formed by developing an electrostatic latent image formed thereon with a toner;

a multi-color developing device which has a plurality of developing units disposed thereon and accommodating respective color toners and develops the electrostatic latent image on the image carrier by a developing unit selected from the plurality of developing units;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material;

a fixing unit which has a pair of rotating members, clamps the transfer material, onto which the toner image has been transferred, between the pair of rotating members at a predetermined fixing position, and fixes the toner image on the transfer material; and a conveying path along which the transfer material passes through the secondary transfer position and the fixing position and which has a partial conveying path extending approximately vertically between the secondary transfer position and the fixing position, wherein the image carrier is disposed at a position at which the image carrier is in contact with the approximately flat-shaped intermediate transfer member on the side thereof where the intermediate transfer member moves in a direction in which the intermediate transfer member approaches the secondary transfer position as well as the image carrier is disposed downstream of a first straight line which is approximately vertical to a direction, in which the partial conveying path extends, of a horizontal line and a vertical line that are in contact with a portion of the intermediate transfer member on the most upstream side thereof with respect to a transfer material conveying direction, and wherein the pair of rotating members are disposed upstream of a second straight line which is approximately vertical to the direction, in which the partial conveying path, of a horizontal line and a vertical line that are in contact with a portion of the intermediate transfer member on the most downstream side thereof with respect to the transfer material conveying direction.

4. An image forming apparatus according to claim 3, comprising a cleaning member that is in sliding contact with the image carrier downstream of a portion thereof which faces the primary transfer position in a rotating direction of the image carrier, wherein the cleaning member is disposed downstream of the first straight line with respect to the transfer member conveying direction.

5. An image forming apparatus according to claim 3, comprising a charging member that charges a portion of the image carrier before an electrostatic latent image is formed in the portion, wherein the charging member is disposed downstream of the first straight line with respect to the transfer member conveying direction.

6. An image forming apparatus according to claim 3, wherein the multi-color developing device is a rotary developing device that has a plurality of developing units, which are disposed about a predetermined center of rotation thereof, and develops the electrostatic latent image on the image carrier by a developing unit which is faced to the image carrier by the rotation of the rotary developing device, and the developing position, at which the electrostatic latent image on the image carrier is developed by the rotary developing device, is disposed downstream of the first straight line with respect to the transfer material conveying direction.

7. An image forming apparatus comprising:

an image carrier which has a predetermined center of rotation and on which a toner image is formed by developing an electrostatic latent image formed thereon with a toner;

a developing device which has a developing roll that is opposite the image carrier, and rotates while carrying a toner on the surface thereof and that conveys the toner to a developing position at which the electrostatic latent image on the image carrier is developed by the toner;

an intermediate transfer member which is disposed in an approximately flat shape and circulatingly moves, onto which the toner image on the image carrier is primarily transferred at a predetermined transfer position, and which has a second transfer position at which the toner image is secondarily transferred onto a transfer material; and a fixing unit which fixes the toner image on the transfer material, which has undergone the transfer of the toner image, thereon at a predetermined fixing position, wherein when the developing roll comes to the developing position, the approximately entire developing roll enters a triangle region formed by the approximately flat-shaped intermediate transfer member, a vertical line in contact with the intermediate transfer member, and a horizontal line in contact with the intermediate transfer member;

a first support roll that supports the intermediate transfer member from the inside thereof at the secondary transfer position; and a second support roll that supports the intermediate transfer member from the inside thereof at a position on the upstream side of the secondary transfer position in a moving direction of the intermediate transfer member and forms a short side of the approximately flat-shaped intermediate transfer member which extends upstream of a transfer material conveying direction in cooperation with the first support roll, wherein the image carrier is disposed so as to come into contact with a long side portion of the intermediate transfer member along which the intermediate transfer member moves in a direction in which the intermediate transfer member approaches the second support roll at approximately the center of the long side portion over a predetermined region of the intermediate transfer member in the moving direction thereof.

8. An image forming apparatus according to claim 7, comprising a rotary developing device that has a plurality of developing units, which are disposed about a predetermined center of rotation thereof, and in which respective color toners are accommodated, and develops an electrostatic latent image formed on the image carrier by a developing unit which is faced to the image carrier by the rotation of the rotary developing device, wherein the developing roll is a developing roll that constitutes a developing unit used in the development executed this time of the plurality of developing units constituting the rotary developing device.

* * * * *